US009284790B2

(12) United States Patent
Zhang et al.

(10) Patent No.: US 9,284,790 B2
(45) Date of Patent: Mar. 15, 2016

(54) INNOVATIVE CUTTING ELEMENT AND CUTTING STRUCTURE USING SAME

(75) Inventors: Youhe Zhang, Spring, TX (US); Jibin Shi, Spring, TX (US); Yuri Burhan, Spring, TX (US)

(73) Assignee: Smith International Inc., Houston, TX (US)

( * ) Notice: Subject to any disclaimer, the term of this patent is extended or adjusted under 35 U.S.C. 154(b) by 653 days.

(21) Appl. No.: 13/542,060

(22) Filed: Jul. 5, 2012

(65) Prior Publication Data

US 2013/0015000 A1 Jan. 17, 2013

Related U.S. Application Data

(60) Provisional application No. 61/599,665, filed on Feb. 16, 2012, provisional application No. 61/512,624, filed on Jul. 28, 2011, provisional application No. 61/505,140, filed on Jul. 7, 2011.

(51) Int. Cl.

| | |
|---|---|
| ***E21B 10/46*** | (2006.01) |
| ***E21B 10/56*** | (2006.01) |
| ***E21B 10/567*** | (2006.01) |
| ***E21B 10/633*** | (2006.01) |

(52) U.S. Cl.

CPC ..... *E21B 10/56* (2013.01); *E21B 10/5673* (2013.01); *E21B 10/633* (2013.01); *Y10T 29/4973* (2015.01)

(58) Field of Classification Search

USPC ..... 175/428, 327, 412, 413, 426, 331, 336, 175/368

See application file for complete search history.

(56) References Cited

U.S. PATENT DOCUMENTS

| | | | | |
|---|---|---|---|---|
| 3,726,352 | A * | 4/1973 | Olov Roos | 175/413 |
| 4,104,344 | A | 8/1978 | Pope et al. | |
| 4,288,248 | A | 9/1981 | Bovenkerk et al. | |
| 4,633,959 | A | 1/1987 | Knox | |
| 5,127,923 | A | 7/1992 | Bunting et al. | |
| 5,678,645 | A * | 10/1997 | Tibbitts | E21B 10/5673 175/426 |
| 5,906,245 | A * | 5/1999 | Tibbitts | E21B 10/5673 175/426 |
| 7,070,011 | B2 * | 7/2006 | Sherwood, Jr. | E21B 10/55 175/428 |
| 7,163,360 | B2 * | 1/2007 | Toyose | B23C 5/00 407/36 |

(Continued)

FOREIGN PATENT DOCUMENTS

| | | |
|---|---|---|
| RU | 2359100 | 6/2009 |
| RU | 2422613 | 6/2011 |
| WO | 2011089125 | 7/2011 |

OTHER PUBLICATIONS

International Search Report and Written Opinion of PCT Application No. PCT/US2012/045528 dated Oct. 25, 2012: pp. 1-7.

*Primary Examiner* — Taras P Bemko

(57) ABSTRACT

A cutting tool is disclosed that includes a tool body, a plurality of cutting element support structures extending from the tool body, at least one slot formed in at least one of the cutting element support structures, a cutting element having a diamond shearing element with a plurality of surfaces, and at least one mechanical retention mechanism adjacent to the cutting element. Each cutting element support structure has a leading face, a top side, and a trailing face, and the slot has two side surfaces, each side surface terminating at the leading face and top side of the cutting element support structure. Each surface of the cutting element has two dimensional values, wherein the cutting element is positioned in the at least one slot such that a plane in which the shortest dimensional value lies intersects the slot side surfaces.

26 Claims, 32 Drawing Sheets

(56) References Cited

U.S. PATENT DOCUMENTS

| | | | | |
|---|---|---|---|---|
| 7,762,359 | B1 * | 7/2010 | Miess | E21B 10/55 175/354 |
| 8,061,452 | B2 * | 11/2011 | Cooley | B23B 27/12 175/383 |
| 8,479,845 | B1 | 7/2013 | Qian et al. | |
| 2006/0032677 | A1 | 2/2006 | Azar et al. | |
| 2007/0278017 | A1 * | 12/2007 | Shen et al. | 175/426 |
| 2008/0223623 | A1 | 9/2008 | Keshavan et al. | |
| 2009/0173548 | A1 * | 7/2009 | Voronin et al. | 175/435 |
| 2010/0270087 | A1 | 10/2010 | Marvel et al. | |
| 2010/0314176 | A1 * | 12/2010 | Zhang et al. | 175/383 |
| 2011/0284293 | A1 | 11/2011 | Shen et al. | |
| 2011/0297454 | A1 | 12/2011 | Shen et al. | |

* cited by examiner

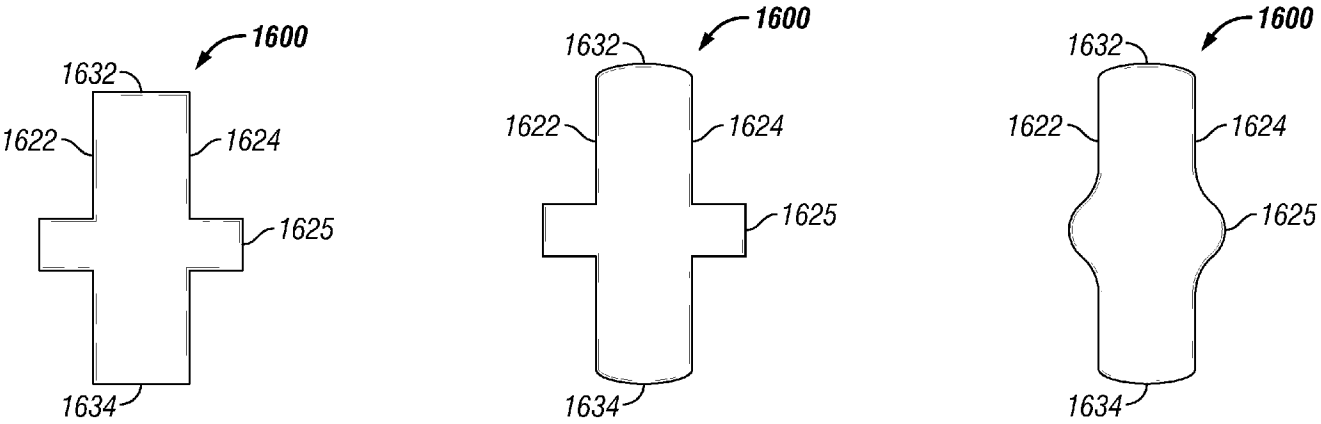
FIG. 16A
FIG. 16B
FIG. 16C
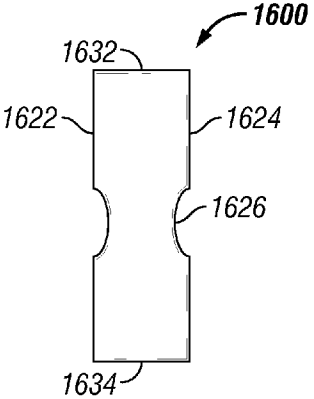
FIG. 16D
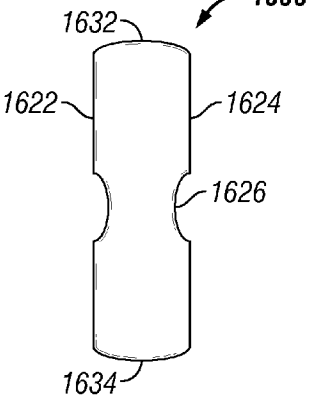
FIG. 16E

INNOVATIVE CUTTING ELEMENT AND CUTTING STRUCTURE USING SAME

CROSS-REFERENCE TO RELATED APPLICATIONS

This application claims the benefit of related U.S. Provisional Application Ser. No. 61/599,665, filed on Feb. 16, 2012, U.S. Provisional Application Ser. No. 61/512,624, filed Jul. 28, 2011, and U.S. Provisional Application Ser. No. 61/505,140, filed Jul. 7, 2011, each of which are herein incorporated by reference in their entirety.

BACKGROUND

1. Field of the Invention

Embodiments disclosed herein relate generally to drill bits and other cutting tools. In particular, embodiments disclosed herein relate to PDC drill bits having diamond shearing elements.

2. Background Art

Historically, there have been two main types of drill bits used for drilling earth formations, drag bits and roller cone bits. The term "drag bits" refers to those rotary drill bits with no moving elements. Drag bits include those having cutting elements attached to the bit body, which predominantly cut the formation by a shearing action. Roller cone bits include one or more roller cones rotatably mounted to the bit body. These roller cones have a plurality of cutting elements attached thereto that crush, gouge, and scrape rock at the bottom of a hole being drilled.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cylindrical cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits. The cutting element substrate provides a way for the ultra hard cutting table to be attached to the drill bit. In particular, the substrate material is generally capable of allowing strong and secure attachment of the cutting element to the drill bit. While the substrate allows for attachment of the ultra hard cutting table to the bit, the use of the substrate tends to place a limit on the thickness of the ultra hard cutting table that is feasible without excessive stresses between the two bodies or excessive risk of delamination of the ultra hard cutting table.

An example of a conventional PDC bit having a plurality of cutters with ultra hard cutting tables is shown in FIG. 1. The drill bit 100 includes a bit body 110 having a threaded upper pin end 111 and a cutter face 112. The cutter face 112 typically includes a plurality of ribs or blades 120 arranged about the rotational axis L of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled. Cutters 150 are conventionally attached to a drill bit or other downhole tool by a brazing process so that the ultra hard cutting table faces into the direction of rotation of the bit. In the brazing process, a braze material is positioned between the cutter substrate and the cutter pocket. The material is melted and, upon subsequent solidification, bonds (attaches) the cutter in the cutter pocket.

A plurality of orifices 116 are positioned on the bit body 110 in the areas between the blades 120, which may be referred to as "gaps" or "fluid courses." The orifices 160 are commonly adapted to accept nozzles. The orifices 160 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Cutting elements commonly used with PDC drill bits may be formed by placing a mixture of diamond particles and catalyst material adjacent to a substrate (typically a carbide substrate) and sintering the assembly, or by providing the catalyst material from the adjacent substrate, wherein the catalyst infiltrates and bonds together the diamond particles to form a polycrystalline diamond layer attached to the substrate. Alternatively, a mixture of a catalyst material and diamond crystals may be placed in a pressure vessel without a substrate and sintered together to form a polycrystalline diamond layer without an attached substrate. The polycrystalline diamond layer may then be immersed in a leaching agent to leach the catalyst material remaining between the bonded together diamond crystals, thereby forming a thermally stable polycrystalline diamond layer.

A significant factor in determining the longevity of PDC cutters is the generation of heat at the cutter contact point with a rock or earth formation, specifically at the exposed part of the PDC layer, caused by friction between the PCD and the formation. This heat causes thermal damage to the PCD in the form of cracks (due to differences in thermal expansion coefficients) which lead to spalling of the polycrystalline diamond layer, delimitation between the polycrystalline diamond and substrate, and back conversion of the diamond to graphite causing rapid abrasive wear. Thermal exposure to the PCD may also occur during brazing of the cutting elements onto the drill bit or other cutting tool. Selection of braze materials depends on their respective melting temperatures, to avoid excessive thermal exposure (and thermal damage) to the diamond layer prior to the bit (and cutter) even being used in a drilling operation.

Conventional polycrystalline diamond is stable at temperatures of up to 700° C., after which observed increases in temperature may result in permanent damage to and structural failure of polycrystalline diamond. This deterioration in polycrystalline diamond is due to the significant difference in the coefficient of thermal expansion of the binder material, e.g. cobalt, as compared to diamond. Upon heating of polycrystalline diamond, the binder material and the diamond lattice will expand at different rates, which may cause cracks to form in the diamond lattice structure and result in deterioration of the polycrystalline diamond. However, thermal fatigue does not only occur at temperatures above 700° C. Rather, the differential expansion (between the binder material and diamond) even occurs at temperatures as low as 300-400° C., still causing thermal fatigue in the diamond body. Further, damage to polycrystalline diamond can also result from the loss of some diamond-to-diamond bonds (from the initiation of a graphitization process) leading to loss of microstructural integrity and strength loss.

In order to overcome this problem, strong acids may be used to "leach" the cobalt from the diamond lattice structure (either a thin volume or entire table) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically nitric acid or combinations of several strong acids (such as nitric and hydrofluoric acid) may be used to treat the diamond table, removing at least a portion of the co-catalyst from the PDC composite. By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such as by processes known in the hart and described in U.S. Pat. No. 5,127,923, which is herein incorporated by reference in its entirety.

Additionally, the design of conventional PDC cutters often results in failure due to wear and/or chipping of the diamond layer. FIGS. 2A and 2B show examples of the failure modes experienced by conventional PDC cutters brazed in a cutter pocket. As shown, chipping and/or wear of the diamond layer particularly affects the part of the diamond layer that is positioned to contact the borehole and the interface region between the diamond layer and substrate. For example, the circled cutter in FIG. 2A has chipping at the part of the diamond layer that contacts the borehole and the circled cutter in FIG. 2B has chipping at the interface region. FIG. 2B also shows a PDC cutter having a wear flat 200 formed at the part of the diamond layer that contacts the borehole. The wear flat 200 has a chord length of about 0.300 inches. As wear flats increase in size, the exposure of the diamond/substrate interface to the cutting action increases, which may lead to more severe failures. FIG. 3 shows a progression of a wear flat 300 forming in the diamond layer 312, interface region 314, and substrate 316 of a conventional PDC cutting element 310. As the chord 309 of the wear flat 300 grows, it increases in size from covering only part of the diamond layer 301, 302, 303 to covering part of the diamond layer, interface region, and substrate 304, 305, 306, 307, 308.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting tool having a tool body, a plurality of cutting element support structures extending from the tool body, at least one slot formed in at least one of the cutting element support structures, a cutting element having a diamond shearing element with a plurality of surfaces, and at least one mechanical retention mechanism adjacent to the cutting element. Each cutting element support structure has a leading face, a top side, and a trailing face, and the at least one slot has two side surfaces, each side surface terminating at the leading face and top side of the cutting element support structure. Each surface of the diamond shearing element has two dimensional values, and the cutting element is positioned in the at least one slot such that a plane in which the shortest dimensional value lies intersects the slot side surfaces.

In another aspect, embodiments disclosed herein relate to a drill bit having a bit body, a plurality of blades extending from the bit body, at least one slot formed in at least one of the plurality of blades, a cutting element having a diamond shearing element with a plurality of surfaces, and at least one mechanical retention mechanism adjacent to the cutting element. Each blade has a leading face, a top side, and a trailing face, and the at least one slot has two side surfaces, each side surface terminating at the leading face and top side of the blade. Each surface of the diamond shearing element has two dimensional values, and the cutting element is positioned in the at least one slot such that a plane in which the longest dimensional value is substantially parallel with the slot side surfaces.

In another aspect, embodiments disclosed herein relate to a drill bit having a bit body, a plurality of blades extending from the bit body, at least one slot formed in at least one of the plurality of blades, a diamond cutting element having a plurality of surfaces, and at least one mechanical retention mechanism adjacent to the cutting element. Each blade has a leading face, a top side, and a trailing face, and the slot has two side surfaces, each side surface terminating at the leading face and top side of the blade. Each surface of the diamond cutting element has two dimensional values, and the cutting element is positioned in the at least one slot such that a plane in which the shortest dimensional value lies does not interface the slot side surfaces.

In another aspect, embodiments disclosed herein relate to a cutting element having two side surfaces, four circumferential surfaces, three dimensional values, and four edges formed by the intersection of the two side surfaces and four circumferential surfaces. Each dimensional value is defined by the longest length measured between two opposite surfaces, and the three dimensional values include a short dimensional value formed between the two side surfaces and two long dimensional values, each long dimensional value formed between two opposite circumferential surfaces. At least one of the four edges has a thermally stable polycrystalline diamond layer extending the entire length of the shortest dimensional value and at least a partial length of each of the two long dimensional values.

In another aspect, embodiments disclosed herein relate to a method of replacing a cutting surface of a cutting element that includes providing a bit body having a plurality of blades extending from the bit body. Each blade has a leading face, a top side, and a trailing face. At least one blade has at least one slot formed therein. The slot has two side surfaces, each side surface intersecting with the leading face and top side of the blade. A cutting element is disposed in the at least one slot. The cutting element has three dimensional values. Each dimensional value is defined by its longest length measured between two opposite surfaces, and the surfaces intersect to form four edges. The cutting element is positioned in the at least one slot such that the shortest dimensional value intersects the slot side surfaces, and at least one mechanical retention mechanism is adjacent to the cutting element. The method further includes removing the at least one mechanical retention mechanism, removing the cutting element from the slot, replacing the cutting element into the slot to expose a different surface at the intersection of the top side and leading face of the blade, and replacing the at least one mechanical retention mechanism.

In yet another aspect, embodiments disclosed herein relate to a drill bit having a bit body, a plurality of blades extending from the bit body, at least one cutter pocket formed in at least one of the plurality of blades, at least one discrete support element having a slot, and a cutting element mechanically retained in the slot. Each blade has a leading face, a top side, and a trailing face. The at least one discrete support element fits within the at least one cutter pocket such that the slot is exposed at the leading face and the top side of the blade. The slot has two opposite side surfaces. The cutting element has three dimensional values. Each dimensional value is defined by its longest length measured between two opposite surfaces, and the surfaces intersect to form four edges. The cutting element is positioned in the at least one slot such that the shortest dimensional value intersects the slot side surfaces.

Other aspects and advantages of the disclosure will be apparent from the following description and the appended claims.

BRIEF DESCRIPTION OF DRAWINGS

FIGS. 16A to 16H show cross-sectional views of cutting elements according to embodiments of the present disclosure.

DETAILED DESCRIPTION

According to embodiments disclosed herein, a novel cutting structure is described that may allow for increased cutting element wear life. More particularly, embodiments disclosed herein relate to diamond shearing elements that are uniquely oriented on a drill bit or other cutting tool in a manner that allows for extended wear. While conventional cutting elements are a cylindrical compact of a disc or table of diamond bonded on a substrate, where the exposed flat surface of the diamond is facing and substantially co-planar with the leading face of the blade so that the axis extending through the compact points in the direction of the bit rotation, the present application departs from such conventional cutters. The present cutting elements do not include a conventional diamond table disc bonded to a substrate (or even bit body in a similar orientation as a conventional cutter). Various embodiments of the cutting elements are described herein as well as the mechanisms for attaching the element to the bit (or other cutting tools), and it is specifically intended that any of the embodiments of cutting elements may be used with any type of retention mechanism described herein.

Figure 1:
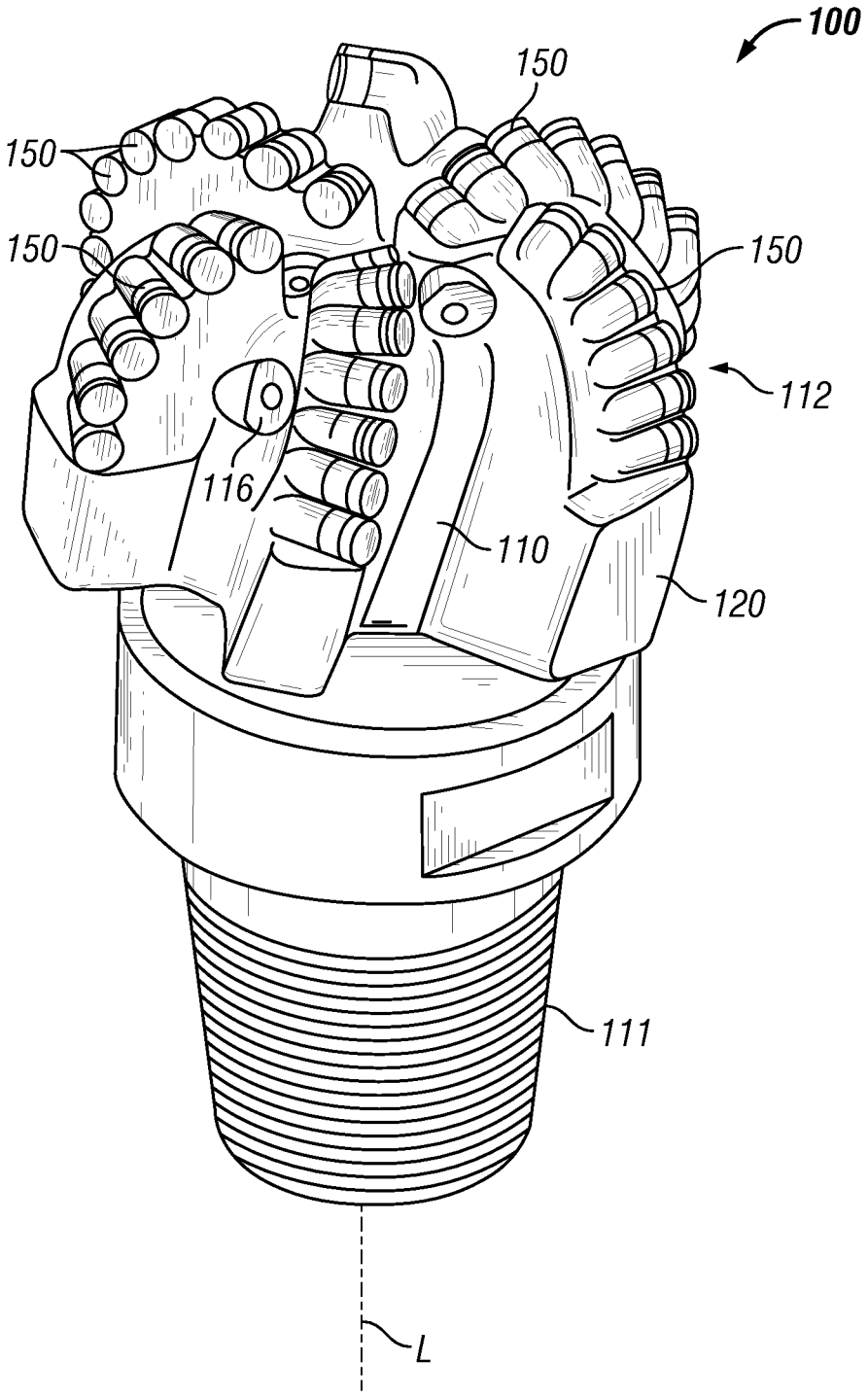
FIG. 1 (Prior Art)
FIG. 1 shows a conventional PDC drill bit.
Figure 2A:
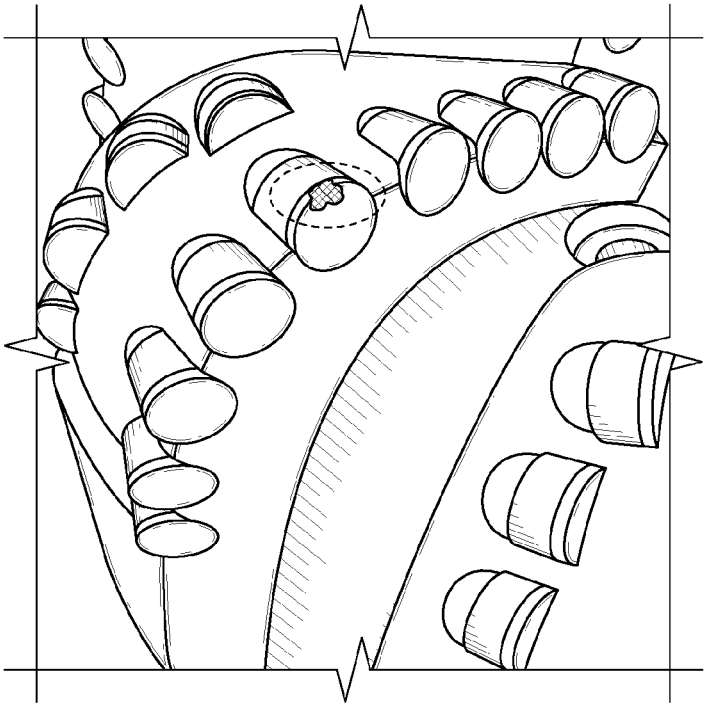
FIG. 2A (Prior Art)
FIGS. 2A and 2B show failure modes of conventional PDC cutting elements.
Figure 2B:
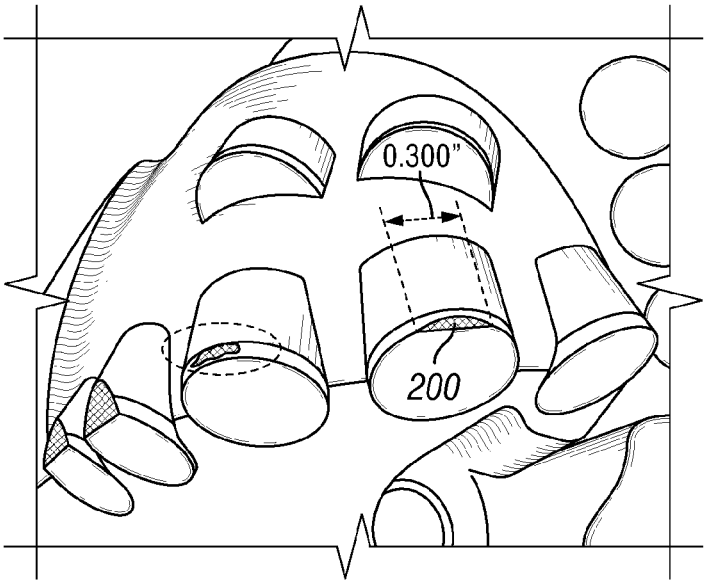
FIG. 2B (Prior Art)
Figure 3A:
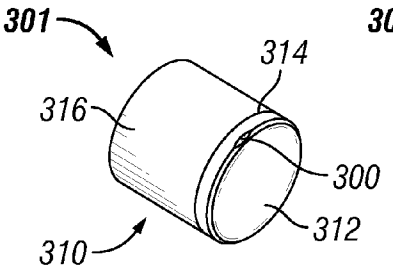
FIG. 3A (Prior Art)
FIG. 3 shows the progression of a wear flat in a conventional cutting element.
Figure 3B:
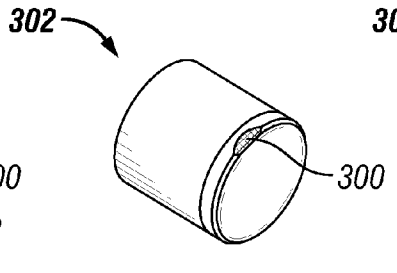
FIG. 3B (Prior Art)
Figure 3C:
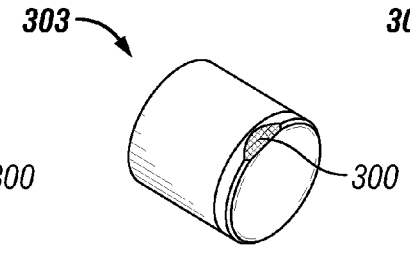
FIG. 3C (Prior Art)
Figure 3D:
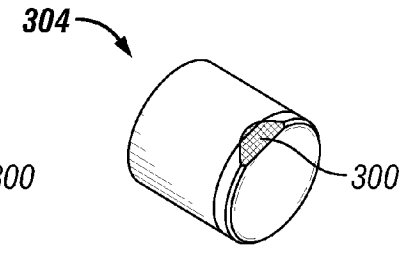
FIG. 3D (Prior Art)
Figure 3E:
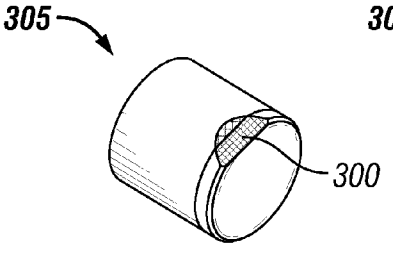
FIG. 3E (Prior Art)
Figure 3F:
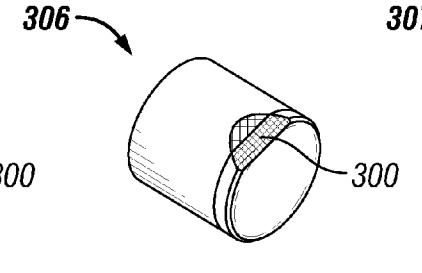
FIG. 3F (Prior Art)
Figure 3G:
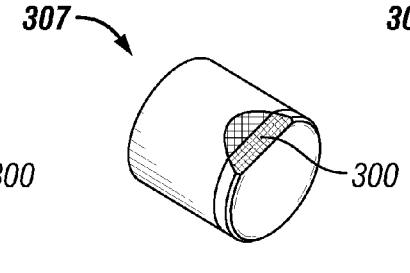
FIG. 3G (Prior Art)
Figure 3H:
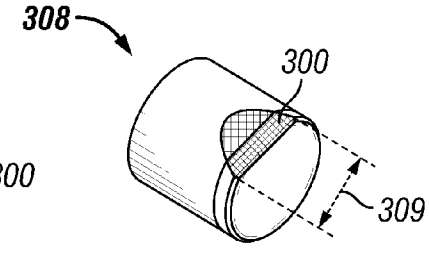
FIG. 3H (Prior Art)
Figure 4A:
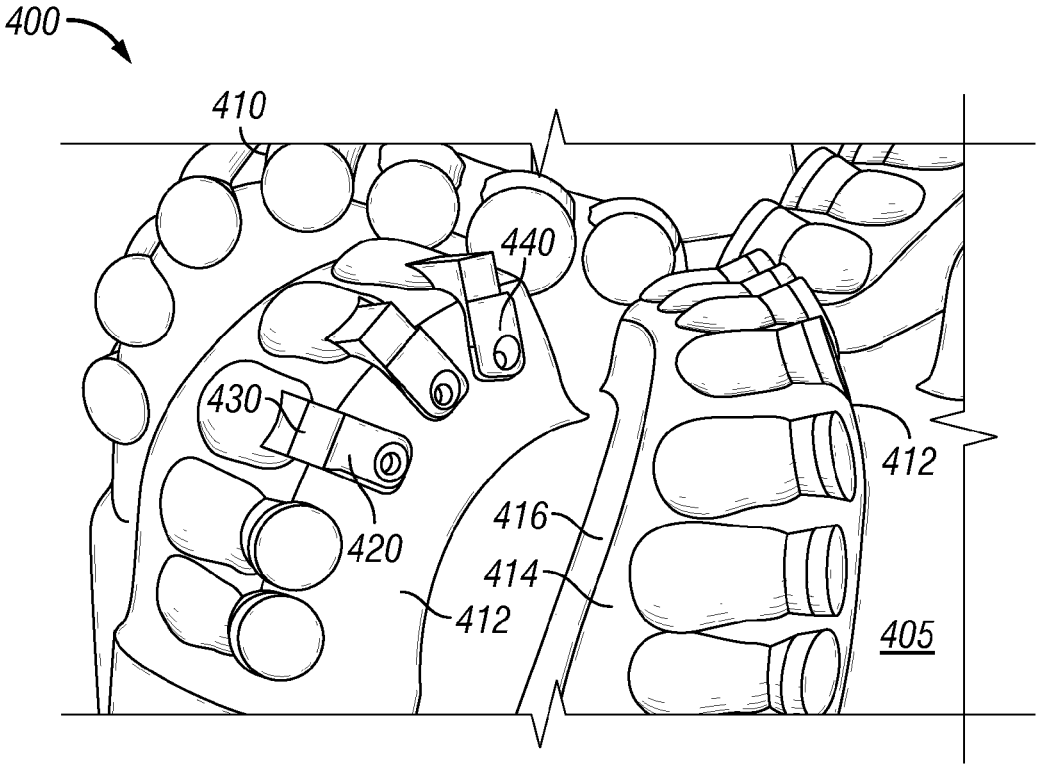
FIGS. 4A and 4B show a side and top view of a drill bit according to embodiments of the present disclosure.
Figure 4B:
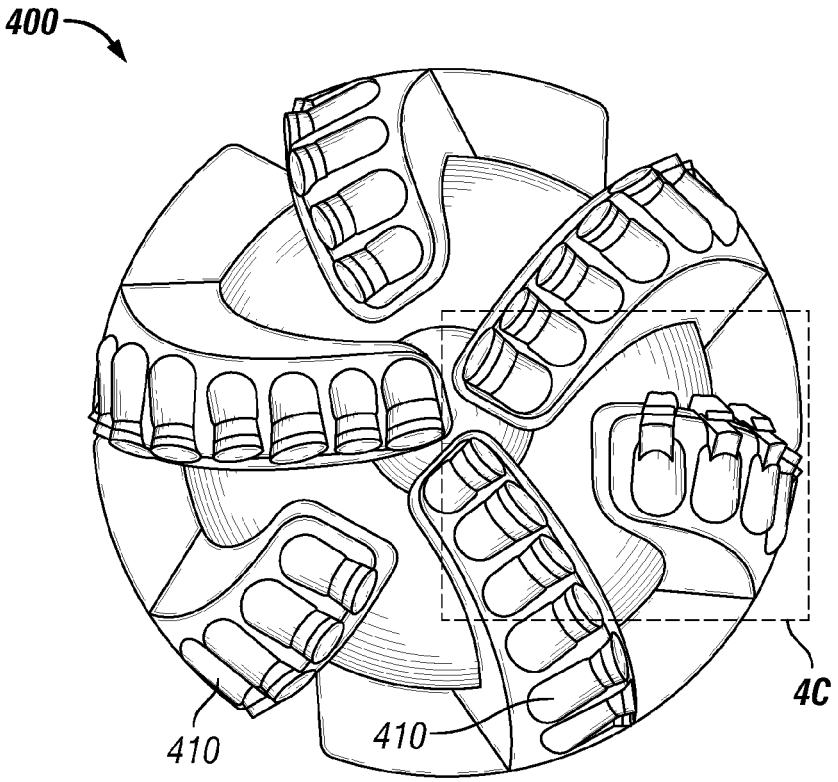
Figure 4C:
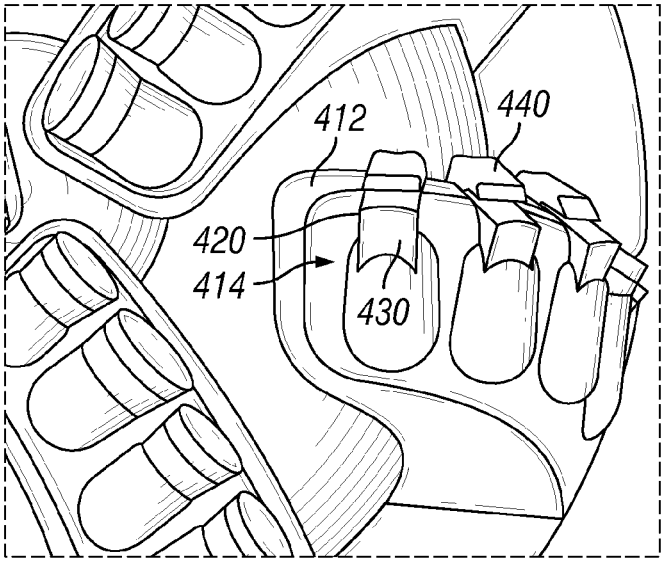

Referring to FIGS. 4A and 4B, a side view (FIG. 4A) and a top view (FIG. 4B) of a drill bit having mechanically attached shearing elements of the present disclosure are shown. The drill bit 400 has a bit body 405 and a plurality of blades 410 extending from the bit body 405, wherein each blade 410 has a leading face 412, a top side 414, and a trailing face 416. At least one slot 420 may be formed in at least one of the plurality of blades 410, wherein the slot 420 has two side surfaces, each side surface intersecting with the leading face 412 and top side 414 of the blade. A cutting element 430 of the present disclosure may be inserted into the slot 420 and held within the slot by a mechanical retention mechanism 440. The mechanical retention mechanism 440 has a retention end and an attachment end, wherein the attachment end is attached to the leading face 412 of the blade such that the retention end covers a portion of the cutting element 430.

Figure 5A:
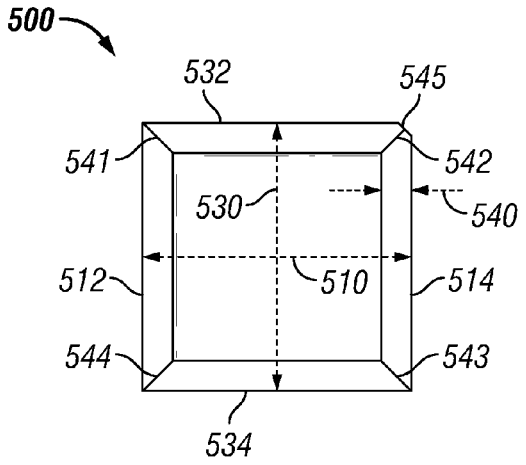
FIGS. 5A, 5B and 5C show cross-sectional views of a cutting element of the present disclosure.
Figure 5B:
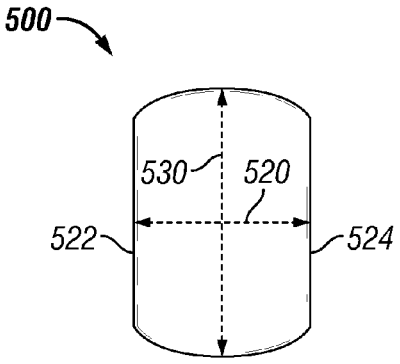
Figure 5C:
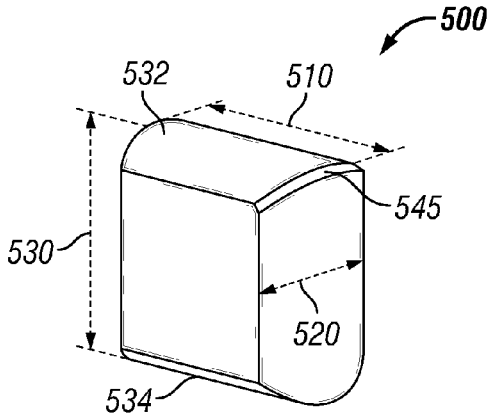

One embodiment of the cutting elements shown in FIGS. 4A and 4B is illustrated in FIGS. 5A, 5B and 5C, showing a side view (FIG. 5A), a front view (FIG. 5B), and a perspective view (FIG. 5C) of the cutting element embodiment. As shown, cutting element 500 possesses six intersecting surfaces, two side surfaces 522 and 524, and one or more (four in the illustrated embodiment) circumferential surfaces 512, 514, 532, 534 extending between the two side surfaces 522, 524. When the cutting element is installed on the bit, as illustrated in FIGS. 4A and 4B, the side surfaces of the cutting element (surfaces 522, 524) interface with the side surfaces of slot 420, and the circumferential surfaces of the cutting element will interface with the rear and bottom surfaces of the slot, and also be exposed at the top side and leading face of the blade. As shown, the circumferential surfaces 512, 514, 532, 534 may intersect to form four edges, 541, 542, 543, 544. In other embodiments, circumferential surfaces may intersect to form less or more than four edges. Further, a bevel 545 may be formed at one or more edge of a cutting element, such as shown in FIGS. 5A, 5B and 5C.

Each surface of the cutting element 500 may be defined by its dimensional values for the surface. For a planar surface, the dimensional values may be the length and width or base and height, depending on the geometrical shape of the surface. For a non-planar surface, the dimensional values may include the length, width, and depth. For example, referring again to FIGS. 5A, 5B and 5C, side surfaces 522 and 524 may have the same dimensional values (in the illustrated embodiment) that include a length of distance 530 and a width of distance 510. Circumferential surfaces 512, 514 may also have the same dimensional values that include a length of distance 530, width of distance 520, and depth of distance 540. Circumferential surfaces 532, 534 may have the same dimensional values that include a length of distance 510, width of distance 520, and depth of distance 540. Thus, circumferential surfaces 512, 514, 532, 534 all have the same dimensional values, with the length and width differing depending on relative location on the surface. The circumferential surfaces 512, 514, 532, 534 are shown as having substantially equal radius of curvatures, while the side surfaces 522 and 524 are both planar. However, in other embodiments, other combinations of planar and non-planar surfaces may be used. For example, all surfaces of a cutting element may be non-planar, including four circumferential surfaces with substantially equal radius of curvatures and side surfaces also having substantially equal radius of curvatures.

Figure 6A:
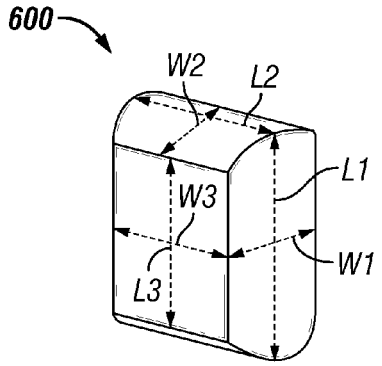
FIGS. 6A, 6B, 6C, 6D and 6E show a front, side, and perspective view of a cutting element according to embodiments of the present disclosure.

While the circumferential surfaces of the cutting element illustrated in FIGS. 5A, 5B and 5C were substantially the same, having substantially the same dimensional values, the present disclosure is not so limited. For example, FIG. 6A illustrates a cutting element 600 where at least one circumferential surface has dimensional values L1 and W1 and at least one circumferential surface has dimensional values L2 and W2. In this embodiment, L1 is greater than L2 and W1 is equal to W2. Further, the cutting element 600 also includes a side surface having dimensional values L3 and W3, where L3 is also less than L1, W3 is greater than W1 and W2, and W3 is less than L2. This cutting element 600 may be installed on a bit in a slot so that the circumferential surface having the dimensional values L1 and W1 or L2 and W2 is the leading surface (faces in the direction of the leading face of the cutting tool). With such orientation, the shortest dimensional width (W1 or W2) lies in a plane that intersects the slot side surfaces. If the cutting element is also oriented with the L2×W2 circumferential surface forming the leading surface, the longest dimensional length will extend rearwardly from the leading or cutting edge of the cutting element. In this embodiment, the cutting element may be installed on a bit such that the circumferential surface extending rearward from the cutting edge or leading edge of the cutting element has the longest dimensional length. One skilled in the art would appreciate that for a symmetrical cutting element, there may be one or more surfaces that possess equal dimensional values, and one or more surfaces that may qualify as having the longest dimensional length.

Figure 6B:
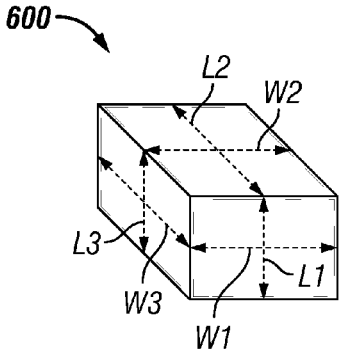
Figure 6C:
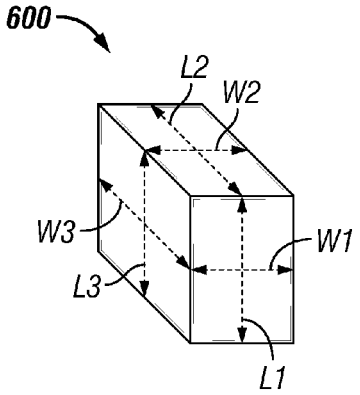

FIG. 6B illustrates another cutting element 600 according to the present disclosure, where at least one surface has dimensional values L1 and W1 and at least one surface has dimensional values L2 and W2, and at least one surface has dimensional values L3 and W3. In this embodiment, L1 is equal to L3 and both are less than L2, W1 is equal to W2 and both are less than W3. This cutting element 600 may be installed on a bit in a slot so that the surface having the dimensional values L1 and W1 or L2 and W2 is the leading surface. With such orientation, the shortest dimensional width (W1 or W2) lies in a plane that intersects the slot side surfaces. If the cutting element is oriented with the L1×W1 surface forming the leading surface, the longest dimensional length will extend rearwardly from the leading or cutting edge of the cutting element. The cutting element 600 illustrated in FIG. 6C possesses the same geometric shape as the cutting element 600 illustrated in FIG. 6B; however, the cutting element 600 in FIG. 6C is rotated 90 degrees. In accordance with various embodiments of the present disclosure, the cutting element 600 may be installed in the bit in a variety of orientations; however, it may be desirable for the length of the diamond surface extending rearwardly from the leading edge to be at least about 0.300 inches in one embodiment, greater than about 0.500 inches in another embodiment, and at least 0.750 inches in yet another embodiment. In another embodiment, it may be desirable to orient the cutting element in any manner so that the smallest dimensional value (length or width) does not interface the slot side surfaces, and the longest dimensional value (depth) extends substantially from the leading face to the trailing face of the blade.

Figure 6D:
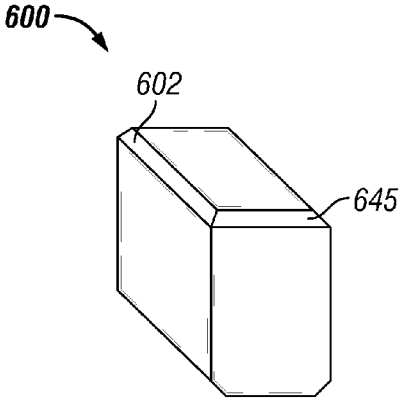
Figure 6E:
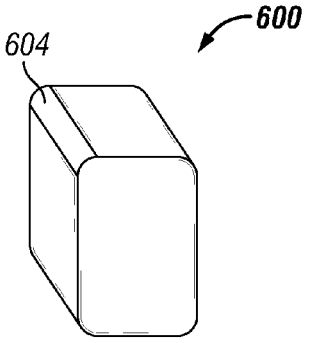

Further, it is also within the scope of the present disclosure that the edges or transitions between one or more of the cutting element surfaces may include a beveled 602 and/or a radiused transition 604, as illustrated in FIGS. 6D and 6E, respectively. Such transitions are excluded from the consideration when determining the shortest dimensional value. As used herein, a beveled edge is a surface that has a dimensional value of less than 0.200 inches. Bevel angles may range from about 15 to 75 degrees, or between 30 and 60 degrees. A radiused transition may have a radius of curvature ranging from about 0.001 to 0.050 inches. In a particular embodiment, the leading or cutting edge of the cutting element (when installed on the bit) may have a beveled edge, as shown in FIGS. 5A and 5C by reference number 545 and in FIG. 6D by reference number 645.

Additional examples of cutting elements of the present disclosure having planar and non-planar surfaces are shown in FIGS. 16A to 16E. As shown, cross-sectional views of a cutting element 1600 are shown, wherein each cutting element has two side surfaces 1622 and 1624, and one or more circumferential surfaces 1632, 1634 extending between the two side surfaces 1622, 1624. When the cutting element is installed on the bit, as illustrated in FIGS. 4A and 4B, the side surfaces of the cutting element (surfaces 1622, 1624) interface with the side surfaces of slot 420, and the circumferential surfaces of the cutting element will interface with the rear and bottom surfaces of the slot, and also be exposed at the top side and leading face of the blade. One or more of the side surfaces 1622, 1624 and the circumferential surfaces 1632, 1634 may be planar or non-planar. For example, the embodiments shown in FIGS. 16A and 16D have planar circumferential surfaces 1632 and 1634, whereas the embodiments shown in FIGS. 16B, 16C and 16E have non-planar circumferential surfaces 1632 and 1634. Further, as shown in FIGS. 16A to 16E, the side surfaces 1622 and 1624 may have non-planar sides. The non-planar side surfaces 1622 and 1624 may vary in their surface geometry, for example, by having one or more protrusions and/or one or more depressions. In the embodiments shown in FIGS. 16A to 16C, both of the side surfaces 1622 and 1624 have a protrusion 1625. The protrusions 1625 may have angularly intersecting surfaces (as shown in FIGS. 16A and 16B) or may have rounded surfaces (as shown in FIG. 16C) or may have a combination of rounded surfaces and angularly intersecting surfaces. Alternatively, as shown in the embodiments of FIGS. 16D and 16E, both of the side surfaces 1622 and 1624 may have a depression 1626. The depressions 1626 may have angularly intersecting surfaces, rounded surfaces, or a combination of rounded surfaces and angularly intersecting surfaces. In other embodiments, a non-planar side surface may have more than one depression, more than one protrusion, or a combination of depression(s) and protrusion(s). According to some embodiments of the present disclosure, the geometry of non-planar side surface(s) of cutting elements may form an additional means of securement to a slot in a cutting tool (or a discrete support element described below). For example, in such embodiments, the non-planar side surface(s) of a cutting element may correspond with the geometry of the slot side surfaces in order to hold the cutting element in the slot and to reduce the likelihood of the cutting element falling out of the slot in at least one direction.

Figure 16F:
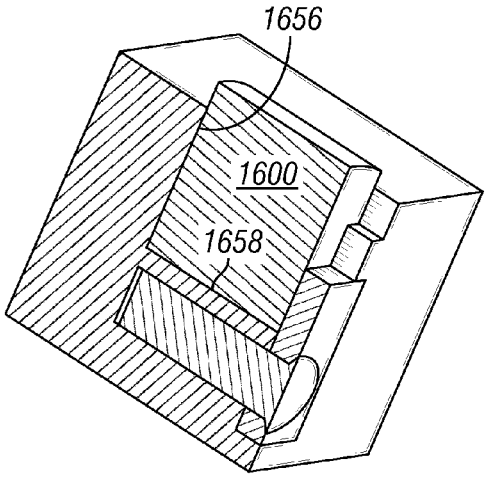
Figure 16G:
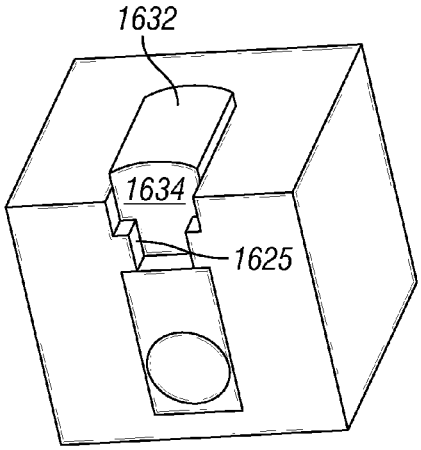
Figure 16H:
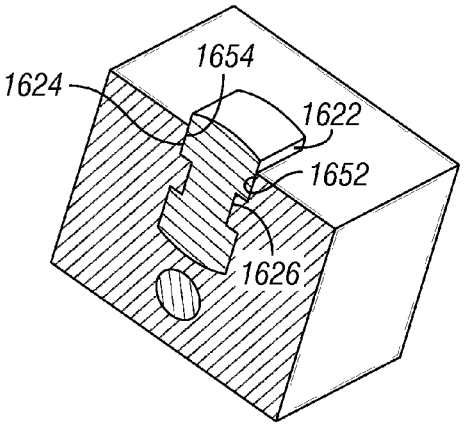

FIGS. 16F to 16H show a perspective view (FIG. 16G) and two cross-sectional views (FIGS. 16F and 16H) of another embodiment of a cutting element having non-planar side surfaces retained within a slot. As shown, a cutting element 1600 has two side surfaces 1622 and 1624, and one or more circumferential surfaces 1632, 1634 extending between the two side surfaces 1622, 1624. The side surfaces 1622, 1624 interface with the slot side surfaces 1652, 1654, and the circumferential surfaces of the cutting element 1600 interface with the slot rear surface 1656 and slot bottom surface 1658 and are exposed at the top side and leading face of the slot 1650. The two side surfaces 1622, 1624 are non-planar, wherein each side surface 1622, 1624 has a depression 1626. The two slot side surfaces 1652, 1654 have correspondingly shaped protrusions 1625 formed therein, such that the cutting element side surface 1622, 1624 substantially mate with the slot side surfaces 1652, 1654. As shown, the depressions 1626 and corresponding protrusions 1625 have angularly intersecting surfaces. However, as mentioned above, depressions and protrusions may have various surface geometries.

As mentioned above, cutting elements of the present disclosure may be positioned in a slot formed at the intersection of the top side and leading face of a blade (or formed in a substrate), such that a surface with the shortest dimensional width lies in a plane that intersects with the slot side surfaces. Once a cutting element is positioned in a slot, the edge formed at the intersection of the surfaces of the cutting element exposed at the top side and leading face of the blade that may contact and cut the borehole may be referred to as the "cutting edge." In other words, the term "cutting edge" is used herein to describe the edge of a cutting element that is exposed at the intersection of the top side and leading face of a blade and that is positioned to contact and cut the borehole while the cutting element is secured in a slot. In one or more embodiments, once a cutting edge is worn or otherwise rendered less effective at cutting the borehole, a cutting element of the present disclosure may be removed and rotated to a new position in the slot to expose a new cutting edge. For example, when an edge of a cutting element that was at one time referred to as the "cutting edge" is rotated to a position within a slot that is not exposed (such that the edge does not cut the borehole), that edge may no longer be referred to as the cutting edge. Instead, the new edge that is exposed to the cutting action of the borehole is referred to as the cutting edge. Thus, the term "cutting edge" is not a fixed edge of a cutting element, but instead, a term relative to the cutting element's position within a slot in a blade (or substrate) and given to whichever edge is in the defined position.

Figure 7A:
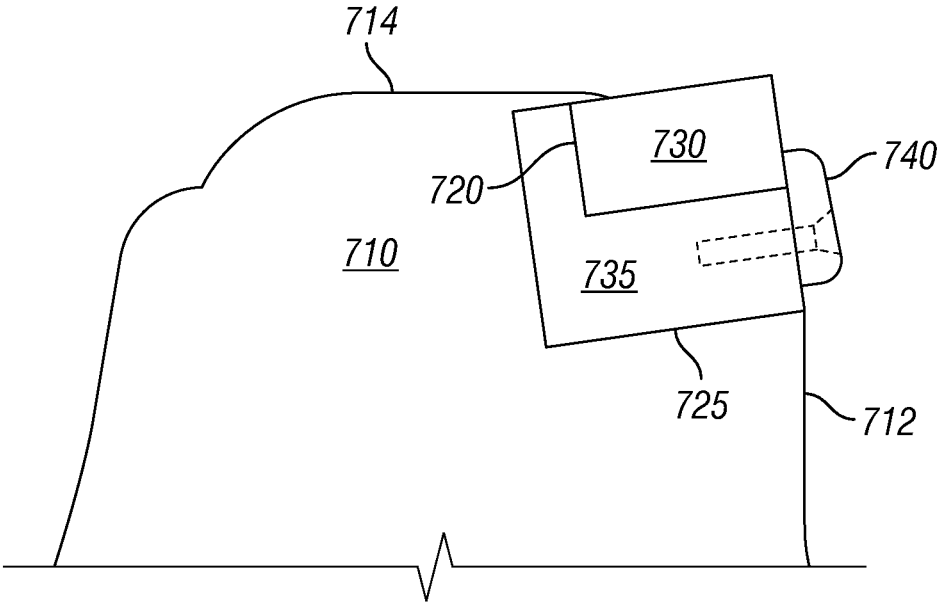
FIGS. 7A, 7B and 7C show a perspective view of a cutting element according to embodiments of the present disclosure.
Figure 7B:
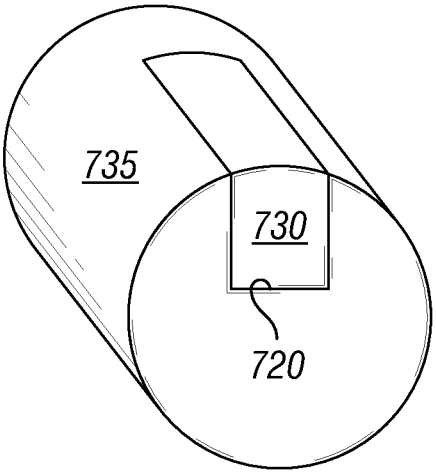
Figure 7C:
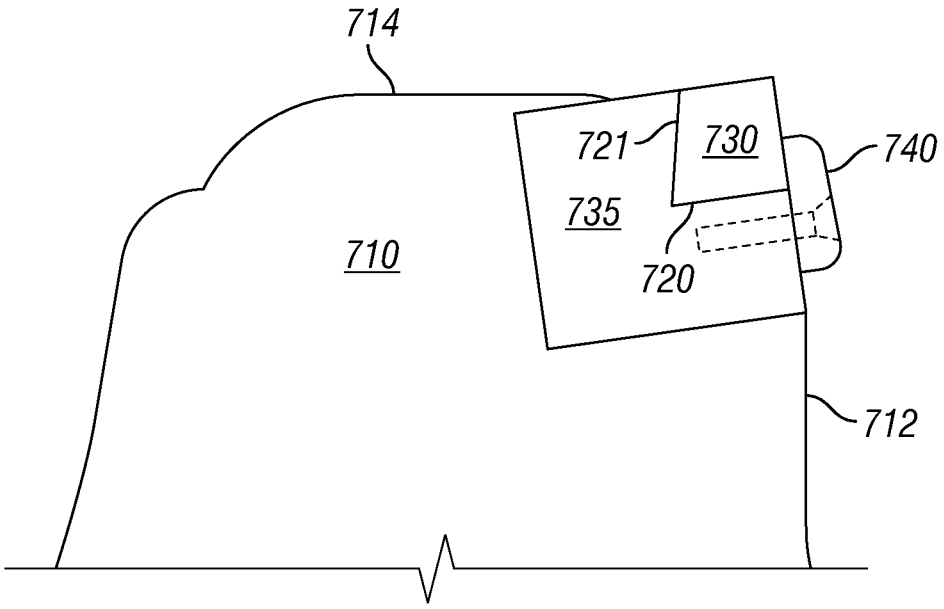

While the embodiment illustrated in FIGS. 4A and 4B show a cutting element of the present disclosure directly interfacing and being supported by the blade of the drill bit, it is also within the scope of the present disclosure that a discrete support element may be placed in between the cutting element and the blade, such as in the embodiment illustrated in FIGS. 7A to 7C. For example, the cutting element 730 may interface and be supported by a discrete support element having a slot 720 in which the cutting element 730 fits. The discrete support element 735 and cutting element 730 assembly may be attached within a conventionally-shaped cutter pocket 725 formed in a drill bit blade 710. Cutting element 730 may be at least in part mechanically held within a discrete support element 735 by a mechanical retention mechanism 740. The mechanical retention mechanism 740 has a retention end and an attachment end, wherein the attachment end is attached to the discrete support element 735 such that the retention end covers a portion of the cutting element 730. By mechanically retaining a cutting element of the present disclosure within a discrete support element that is attached to a blade rather than directly to the blade, the cutting elements of the present disclosure may be adapted to fit within conventional cutter pockets as well as the slots of the present disclosure. For example, a cutting element 730 may be inserted into a slot 720 formed in a discrete support element 735, wherein the discrete support element fits within a conventional cutter pocket, such as a cutter pocket with a generally cylindrical shape (as illustrated in FIG. 7B). The discrete support element 735 may be positioned within the cutter pocket 725 such that the slot 720 is exposed at the leading face 712 and the top side 714 of the blade 710. The slot 720 may have the same shape as slots formed directly in a blade (as described above referencing FIGS. 4A and 4B), for example, having two opposite side surfaces that each intersects the surfaces of the discrete support element 735 exposed at the leading face 712 and the top side 714 of the blade 710. Further, cutting element 730 may have any of the geometrical shapes and dimensional values described herein and may be installed on a bit using any of the orientations described herein.

The discrete support element 735 may be attached within the cutter pocket 725 by means known in the art, such as brazing, and a cutting element 730 of the present disclosure may be mechanically retained within the discrete support element 735. Cutting elements of the present disclosure may be mechanically held within the discrete support element by the mechanical retention mechanism, as shown in FIGS. 7A and 7C, and/or by other mechanical retention means. For example, FIG. 7A shows a cross-sectional view of a cutting element 730 mechanically held within a discrete support element 735 by a mechanical retention mechanism 740 and by covering a portion of the cutting element 730 exposed to the top side 714 of the blade 710 with part of the bit blade material 710. In another embodiment, shown in FIG. 7C, a cutting element 730 may be mechanically held within a substrate 735 by the mechanical retention mechanism 740 and by the discrete support element 735. In particular, the cutting element 730 may be held within a slot 720 formed in the discrete support element, wherein the slot 720 has a tapered wall 721 that retains the cutting element 730.

Cutting elements of according to the present disclosure may be mechanically retained within a slot by one or more types of mechanical retention mechanisms adjacent to the cutting element. According to some embodiments, a cutting element may be mechanically retained within a slot by a mechanical retention mechanism positioned adjacent to the leading face of the cutting element support structure. In other embodiments, a cutting element may be mechanically retained within a slot by one or more mechanical retention mechanisms that are not adjacent to the leading face of the cutting element support structure, which may include, for example, spring retention mechanisms, pins, screws, or back retainers. In other embodiments, a cutting element may be mechanically retained by one or more tapered slot walls and/or by a portion of the cutting element support structure that impedes removal of the cutting element. For example, a slot may have more than one tapered wall that retains a cutting element of the present disclosure so that a mechanical retention mechanism positioned at the leading face of the cutting element support structure is not needed to retain the cutting element. In yet other embodiments, a cutting element may be retained by mating surface geometry between the cutting element and the slot. For example, the slot side walls and cutting element side surfaces may have corresponding non-planar shapes (e.g., grooves or depressions and ridges or protrusions) to mechanically retain the cutting element to the cutting element support structure, such as a blade or a discrete support element. By mechanically securing a cutting element of the present disclosure in a discrete support element that fits within a conventional cutter pocket, the cutting element may be rotated or replaced upon substantial wear, as well as be adapted to fit within bits having conventional cutter pockets. According to yet other embodiments, a cutting element may be mechanically retained within a slot by a combination of two or more of a mechanical retention mechanism positioned adjacent to the leading face of the cutting element support structure, a mechanical retention mechanism positioned adjacent to the cutting element but not necessarily adjacent to the leading face of the cutting element support structure, a portion of the cutting element support structure, tapered slot walls, and mating surface geometry. Further, additional means of mechanically retaining a cutting element according to the present disclosure are described below. The embodiments described below relate to the manner in which the cutting elements of the present disclosure are held on a cutting tool. However, other variations and combinations of retaining the cutting elements within a slot may be used, including for example, mechanical retention mechanisms and metallurgical or chemical attachment methods.

Figure 17A:
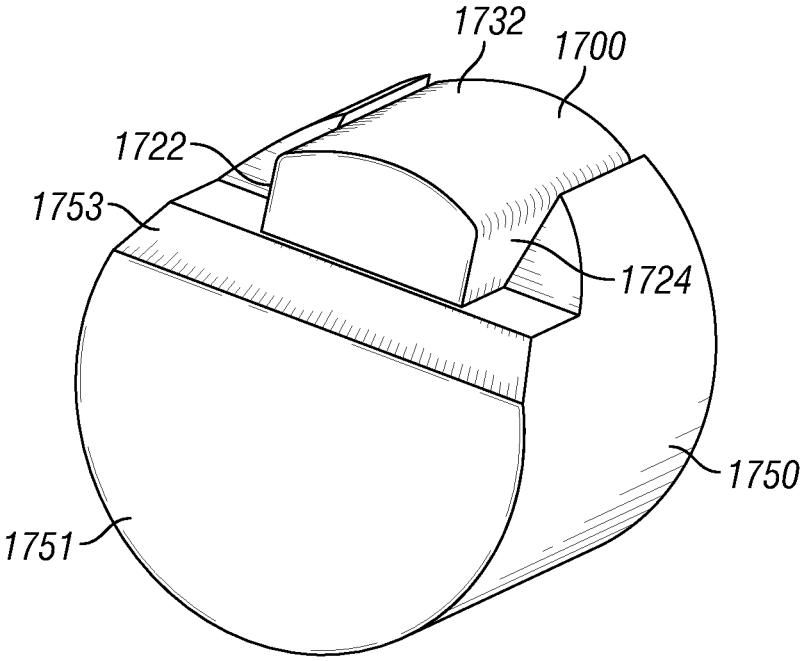
FIGS. 17A and 17B show perspective views of cutting elements according to embodiments of the present disclosure.
Figure 17B:
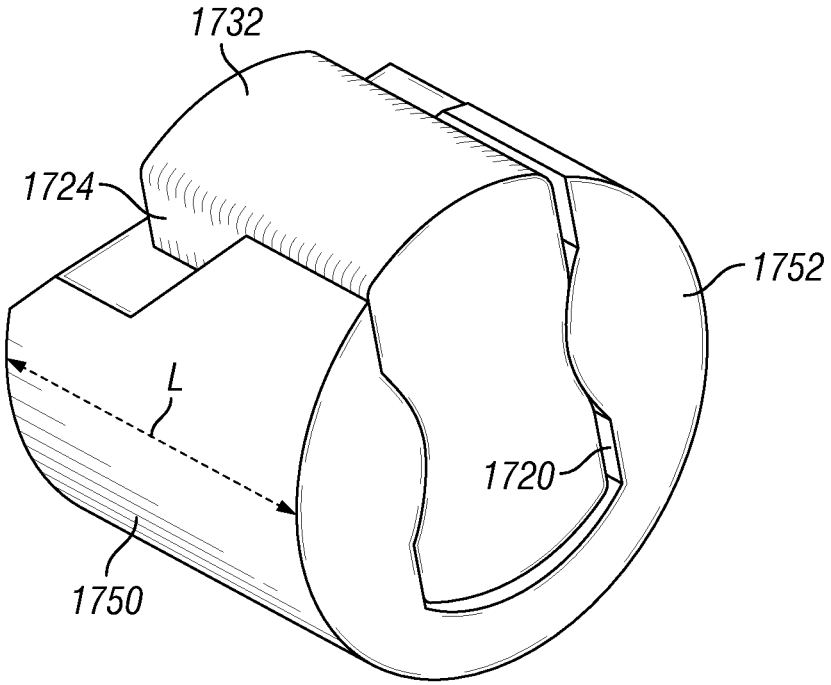
Figure 17C:
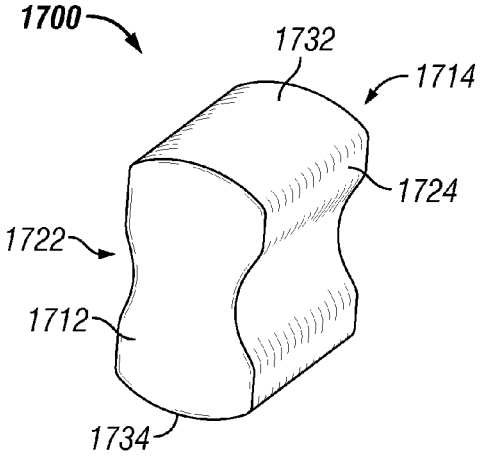
Figure 17D:
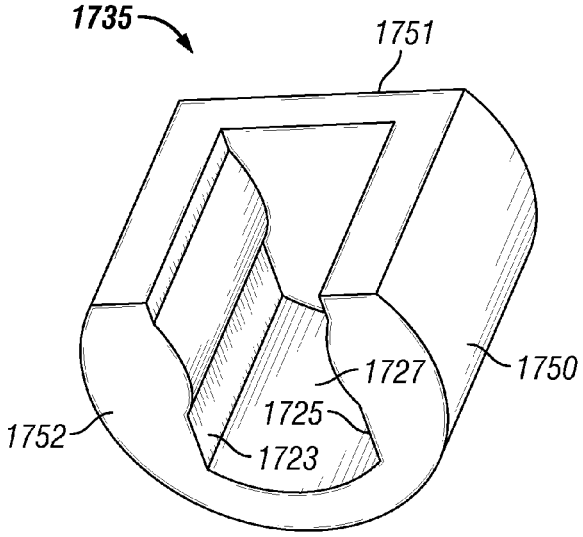
Figure 17E:
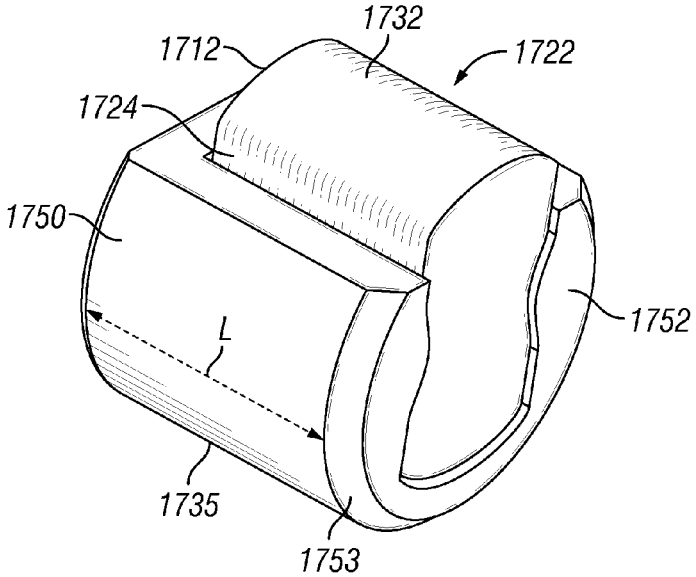

Referring now to FIGS. 17A and 17B, embodiments of cutting elements held within discrete support elements are shown having corresponding non-planar surfaces. As shown, cutting elements 1700 having non-planar side surfaces 1722, 1724 and/or non-planar circumferential surfaces 1712, 1714, 1732, 1734 may interface and be supported by a discrete support element 1735 having a slot 1720 in which the cutting element 1700 fits. The discrete support element 1735 and cutting element 1700 assembly may be attached within a conventionally-shaped cutter pocket formed in a drill bit blade. The discrete support element may be formed of a carbide material, such as tungsten carbide. Further, in particular embodiments, the discrete support element may serve as the mechanical retention mechanism.

As shown in FIGS. 17A and 17B, the discrete support element 1735 has an outer circumferential surface 1750, a front surface 1751, and a back surface 1752, wherein once the discrete support element 1735 is positioned in a cutter pocket of a cutting tool, the front surface 1751 may face the leading face of the cutting tool and the back surface 1752 may interface with the back wall of the cutter pocket. Bevels 1753 may be formed at one or more of the intersections between the outer circumferential surface 1750, front surface 1751, and back surface 1752 of the discrete support element 1735. The discrete support element 1735 has a slot 1720 formed therein, wherein the slot side walls 1723, 1725 and the slot bottom wall 1727 have a non-planar geometry. However, in other embodiments, a discrete support element may have a slot formed therein with planar inner wall surfaces or a combination of planar and non-planar inner wall surfaces. Non-planar surfaces, such as cutting element side surfaces and slot side walls, may include, for example, corresponding depressions, protrusions, and/or a combination of both depressions and protrusions, as discussed above with reference to FIGS. 16A to 16E. Further, the slot 1720 may intersect the front surface, the back surface, or both the front and back surfaces of a discrete support element. For example, while the discrete support elements shown in FIGS. 7A to 7C have a slot 720 formed therein that intersects with the front surface of the discrete support element, the discrete support elements shown in FIGS. 17A and 17B have a slot 1720 that intersects with the back surface 1752 of the discrete support element 1735. In embodiments having a slot that intersects with the back surface but not the front surface of a discrete support element (as shown in FIGS. 17A and 17B), the front surface 1751 of the discrete support element 1735 may cover a portion of the adjacent cutting element circumferential surface, thus forming the mechanical retention mechanism. Alternatively, in embodiments having a slot that intersects with the front surface but not the back surface of a discrete support element (as shown in FIGS. 7A to 7C), the back surface of the discrete support element may cover a portion of the adjacent cutting element circumferential surface.

Further, a portion of the length of the outer circumferential surface of a discrete support element may be removed to increase exposure of a cutting element. For example, as shown in FIG. 17A, a portion of the length L of the outer circumferential surface 1750 of the discrete support element 1735 extends completely to an exposed cutting element circumferential surface 1732 while the remaining portion of the outer circumferential surface 1750 extends partially to the exposed cutting element circumferential surface 1732, thereby exposing a portion of the cutting element side surfaces 1722 and 1724. Alternatively, as shown in FIG. 17B, the entire length L of the outer circumferential surface 1750 may extend partially to the exposed cutting element circumferential surface 1732 to expose a portion of the cutting element side surfaces 1722 and 1724 and a portion of another cutting element circumferential surface 1712. In other embodiments, a portion of the length of the outer circumferential surface may extend completely to an exposed cutting element circumferential surface while the remaining portion of the outer circumferential surface extends the entire circumference of the discrete support element (as shown in FIGS. 7A to 7C and FIGS. 19B and 21A to 21C described below).

Figure 18A:
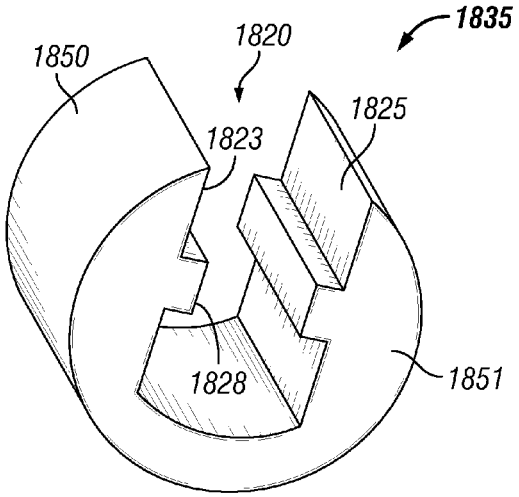
FIGS. 18A, 18B and 18C show perspective views of a cutting element and discrete support element according to embodiments of the present disclosure.
Figure 18B:
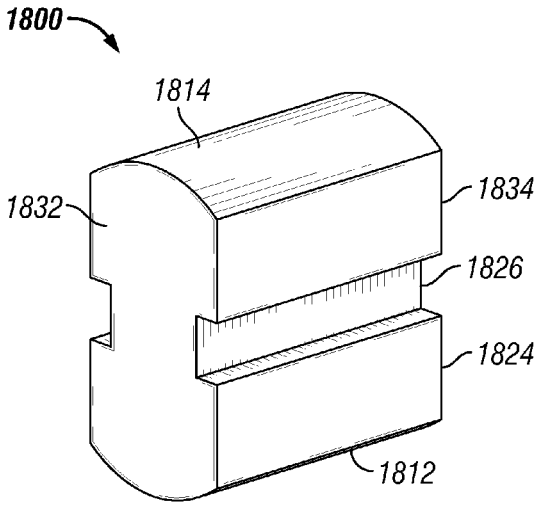
Figure 18C:
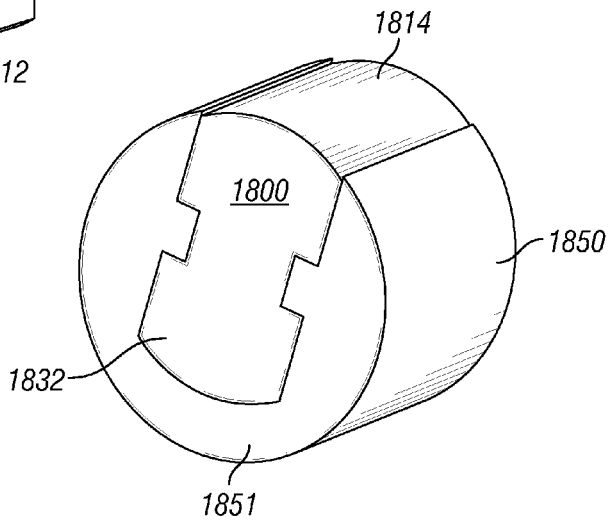

In yet other embodiments, the entire length of the outer circumferential surface may extend completely to an exposed cutting element circumferential surface. For example, referring to FIGS. 18A to 18C, a cutting element 1800 having non-planar side surfaces 1822, 1824 and circumferential surfaces 1812, 1814, 1832, 1834 may interface and be supported by a discrete support element 1835 having a slot 1820. Particularly, the cutting element side surfaces 1822, 1824 each have a depression 1826 formed therein, and the slot side walls 1823, 1825 each have a corresponding shaped protrusion 1828, wherein the cutting element 1800 may fit within the discrete support elements 1835. The discrete support element 1835 and cutting element 1800 assembly may be attached within a conventionally-shaped cutter pocket formed in a drill bit blade. The cutting element 1800 may be retained in the discrete support element 1835 by metallurgical attachment methods and/or by mechanical retention mechanisms. For example, the cutting element 1800 may be retained in the discrete support element 1835 by brazing and/or by its geometry (e.g., the cutting element 1800 may increase in width from the leading face to the trailing face). Further, the discrete support element 1835 has an outer circumferential surface 1850, a front surface 1851, and a back surface, wherein once the discrete support element 1835 is positioned in a cutter pocket of a cutting tool, the front surface 1851 may face the leading face of the cutting tool and the back surface may interface with the back wall of the cutter pocket. The outer circumferential surface 1850 of the discrete support element 1835 extends completely around the cutting element side surfaces 1822, 1824 and one of the circumferential surfaces 1812 to an exposed cutting element circumferential surface 1814. Particularly, the entire length of the outer circumferential surface 1850 extends to the exposed cutting element circumferential surface 1814, wherein the length of the exposed cutting element circumferential surface 1814 is equal to the length of the outer circumferential surface 1850 of the discrete support element 1835. As shown, cutting element circumferential surfaces 1832 and 1834 are also exposed at the discrete support element front surface 1851 and back surface, respectively. However, other combinations of cutting element circumferential surfaces may be exposed in a discrete support element.

Figure 19A:
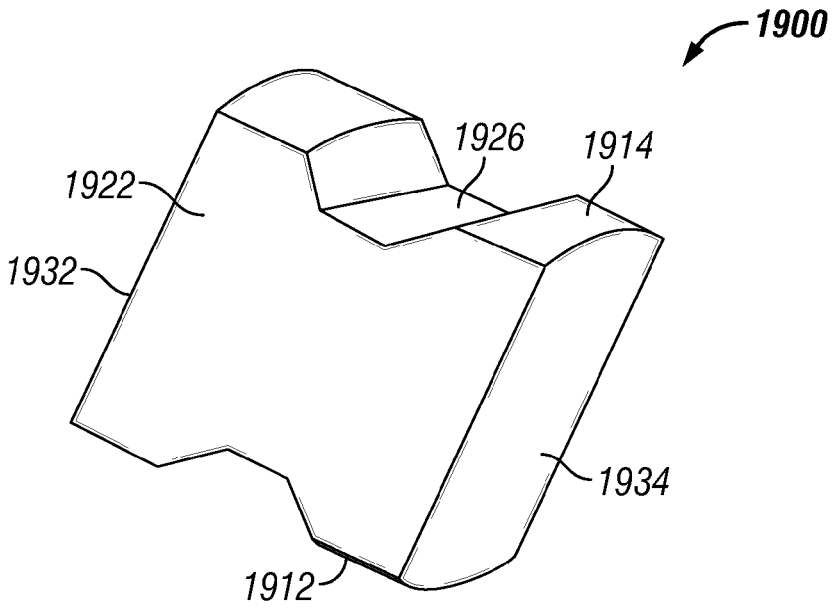
FIGS. 19A and 19B show perspective views of a cutting element and discrete support element according to embodiments of the present disclosure.
Figure 19B:
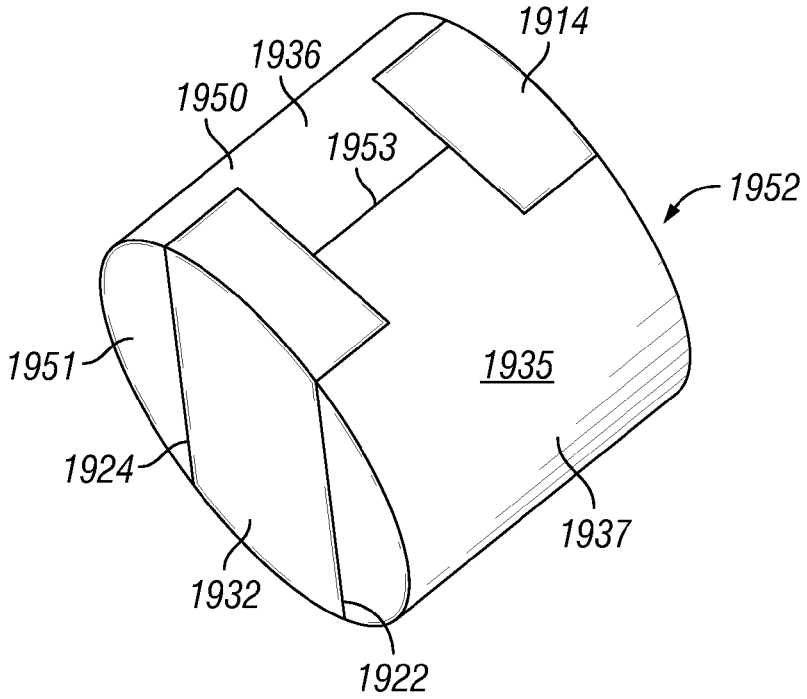

According to some embodiments of the present disclosure, a discrete support element may be made of more than one separate piece. For example, FIGS. 19A and 19B show an embodiment of a cutting element 1900 disposed in a discrete support element 1935, wherein the discrete support element 1935 is assembled around the cutting element 1900 using two separate pieces 1936, 1937. The cutting element 1900 has two planar side surfaces 1922, 1924 and circumferential surfaces 1912, 1914, 1932, 1934. Circumferential surfaces 1912 and 1914 have depressions 1926 formed therein. The discrete support element 1935 includes two pieces 1936, 1937 that are assembled around the cutting element 1900, wherein the two pieces 1936, 1937 may be bonded or brazed together (line 1953 represents the interface between the two pieces) and/or to the cutting element. In other embodiments, a discrete support element may be assembled from more than two pieces. The assembled discrete support element 1935 has an outer circumferential surface 1950, a front surface 1951, and a back surface 1952. As shown, a portion of the length of the outer circumferential surface 1950 of the assembled discrete support element 1935 extends the entire circumference of the discrete support element and completely around the cutting element 1900 (covering the depressions 1926), while the remaining portions of the length of the outer circumferential surface 1950 may extend to the cutting element circumferential surfaces 1912 and 1914. A circumferential shaped discrete support element, such as shown in FIGS. 19A and 19B, may allow for cutting elements of the present disclosure to be secured within conventionally shaped cutter pockets rather than slots formed directly in a cutting tool.

Figure 20A:
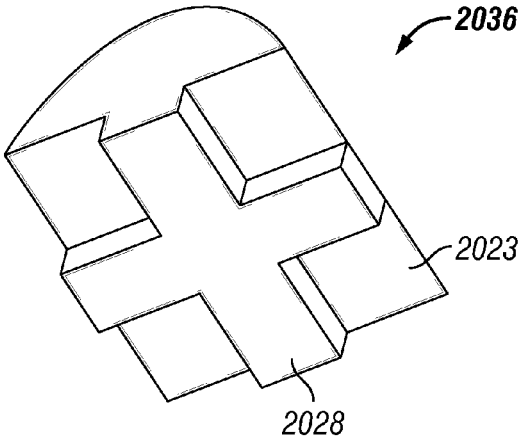
FIGS. 20A, 20B and 20C show perspective views of a cutting element and discrete support element according to embodiments of the present disclosure.
Figure 20B:
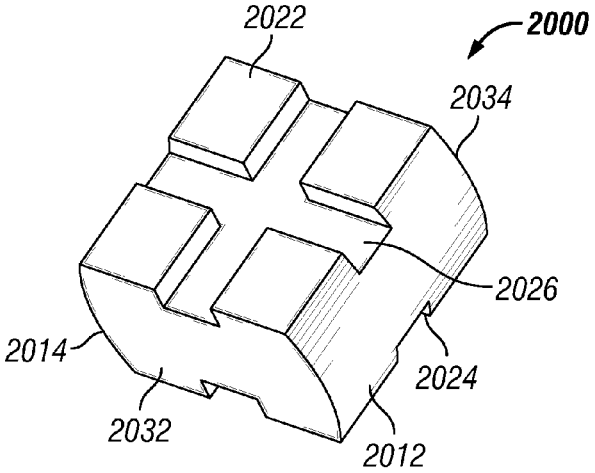
Figure 20C:
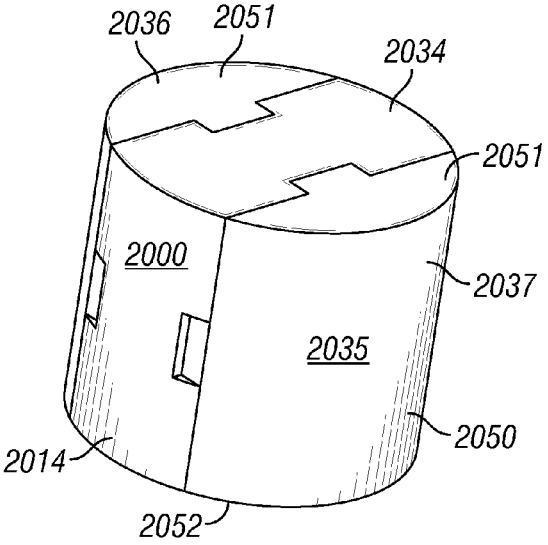

FIGS. 20A to 20C show another example of an embodiment having a discrete support element made of more than one piece. Particularly, FIG. 20A shows a perspective view of a piece used to form the discrete support element 2035; FIG. 20B shows a perspective view of a cutting element 2000; and FIG. 20C shows the cutting element 2000 assembled within the discrete support element 2035. The cutting element 2000 has two non-planar side surfaces 2022, 2024 and circumferential surfaces 2012, 2014, 2032, 2034, wherein the side surfaces 2022, 2024 each have a depression 2026 formed therein. As shown, the depressions 2026 may have a cross shape. However, according to other embodiments, depressions formed in cutting element side surfaces and/or slot side walls may have other shapes and sizes or may be protrusions. The pieces 2036, 2037 of the discrete support element 2035 (one of which is shown separately in FIG. 20A) may have a side wall 2023 with a correspondingly shaped protrusion 2028 formed thereon, such that the protrusions 2028 formed on the side walls 2023 mate with the depressions 2026 formed in the cutting element side surfaces. The discrete support element pieces 2036, 2037 may be assembled around the cutting element 2000, wherein the assembled discrete support element 2035 has a front surface 2051, a back surface 2052, and an outer circumferential surface 2050. As shown, the front surface 2051 is flush with circumferential surface 2034, the back surface 2052 is flush with circumferential surface 2032, and the outer circumferential surface 2050 is flush with cutting element circumferential surfaces 2012 and 2014. The cutting element and discrete support element assembly may be disposed within a conventional bit cutter pocket. Further, discrete support element pieces may be vacuum brazed or otherwise secured to the cutting element, and the cutting element assembly may be brazed into a bit cutter pocket, for example. However, other means known in the art of securing a cutting element to a cutter pocket may be used.

Figure 21A:
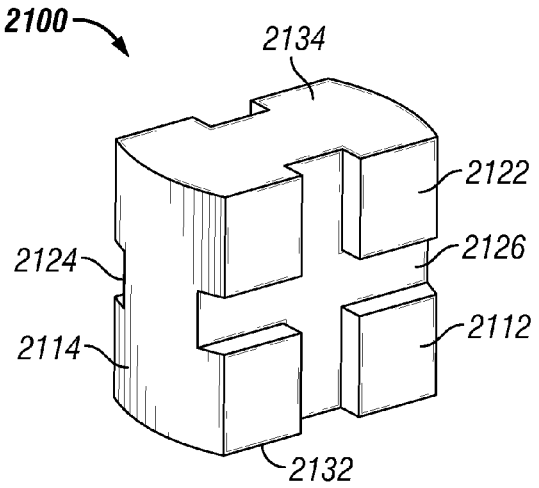
FIGS. 21A, 21B and 21C show perspective views of a cutting element and discrete support element according to embodiments of the present disclosure.
Figure 21B:
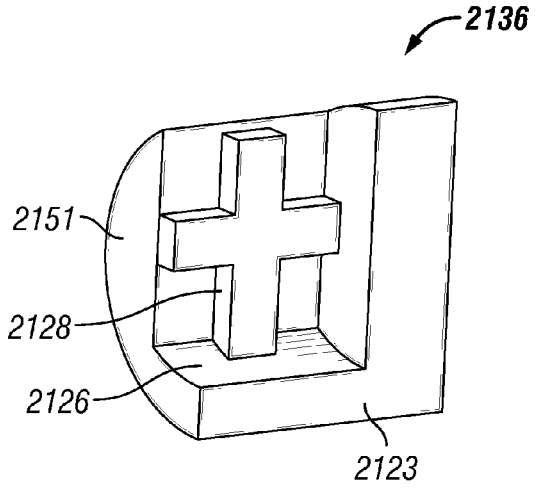
Figure 21C:
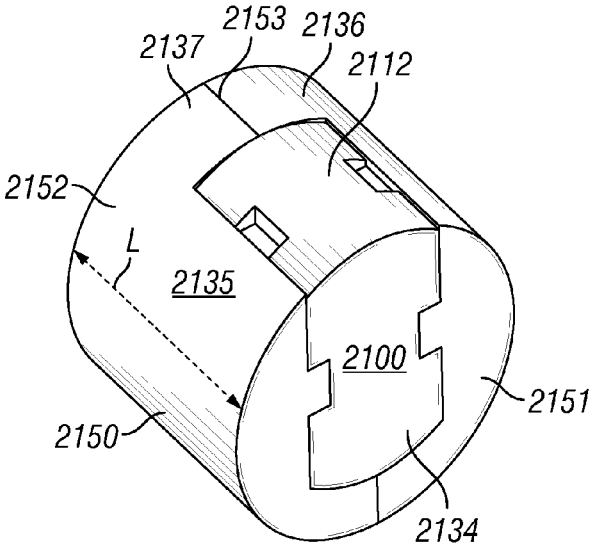

Another embodiment having a discrete support element made of more than one piece is shown in FIGS. 21A to 21C. Specifically, FIG. 21A shows a perspective view of a cutting element 2100 that has two non-planar side surfaces 2122, 2124, two non-planar circumferential surfaces 2112, 2114, and two planar circumferential surfaces 2132, 2134. The side surfaces 2122, 2124 have depressions 2126 formed therein. FIG. 21B shows a perspective view of one of the pieces 2136 of a discrete support element. As shown, the discrete support element piece 2136 has a side wall 2123 with a combination protrusion 2128 and depression 2126 geometry formed thereon. The geometry of the side walls 2123 corresponds with the geometry formed in the cutting element side surfaces 2122, 2124 such that when the discrete support element pieces 2136, 2137 are assembled around the cutting element 2100, the side walls 2123 mate with the cutting element side surfaces 2122, 2124. FIG. 21C shows a perspective view of discrete support element pieces 2136, 2137 assembled around the cutting element 2100. As assembled, the discrete support element 2135 has an outer circumferential surface 2150, a front surface 2151, and a back surface 2152. The front surface 2151 is flush with one of the planar circumferential surfaces 2134 of the cutting element 2100, while the back surface 2152 covers the circumferential surface 2132. A portion of the length L of the outer circumferential surface 2150 extends around the cutting element side surfaces 2122, 2124 and one of the circumferential surfaces 2114 so that circumferential surface 2112 is exposed. The remaining portion of the length L of the outer circumferential surface 2150 does not extend around the cutting element 2100, but rather, forms a solid or continuous discrete support element section. According to embodiments of the present disclosure, a cutting element may extend the entire length of the discrete support element (for example, as shown in FIGS. 20A to 20C), or a cutting element may extend a partial length of the discrete support element (for example, as shown in FIGS. 21A to 21C).

In embodiments of the present disclosure that have a discrete support element made of two or more pieces, the discrete support element pieces may be bonded to the cutting element and to each other at one or more discrete support element interfaces. For example, the discrete support element shown in FIG. 19B has two discrete support element interfaces 1953, wherein the pieces are bonded together on opposite sides of a cutting element. In the embodiment shown in FIG. 21C, the discrete support element pieces 2136, 2137 are bonded together at one discrete support element interface 2153, wherein the interface 2153 extends around a portion of the cutting element 2100. In the embodiment shown in FIG. 20C, the discrete support element pieces 2036, 2037 are not bonded to each other, and thus do not have a discrete support element interface. Rather, the discrete support element pieces 2036, 2037 may be secured only to the cutting element 2000.

Figure 22A:
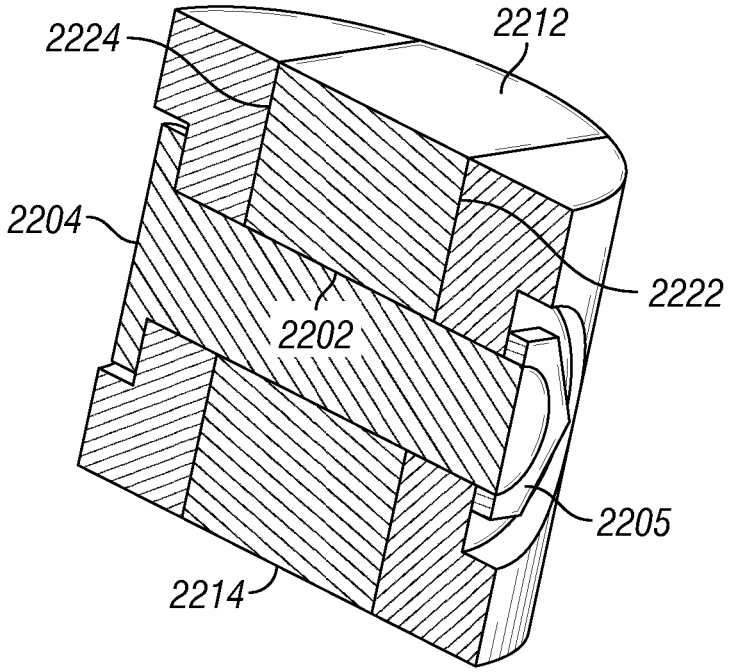
FIGS. 22A and 22B show a cross-sectional view and a perspective view of a cutting element and discrete support element according to embodiments of the present disclosure.
Figure 22B:
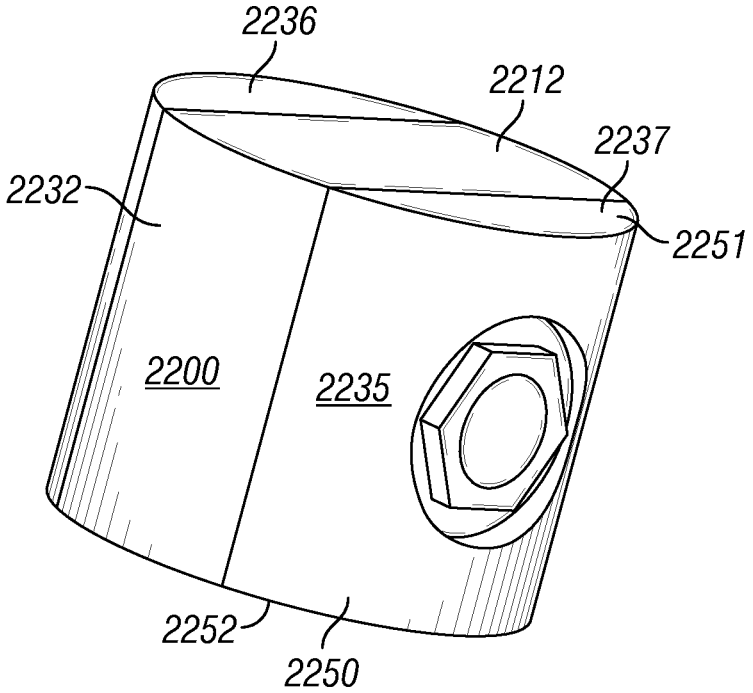

Referring now to FIGS. 22A and 22B, a cross-sectional view and a perspective view of a cutting element 2200 disposed within a discrete support element 2235 are shown. The cutting element 2200 has two planar side surfaces 2222, 2224, circumferential surfaces 2212, 2214, 2232, and a hole 2202 extending through the cutting element 2200 from one side surface 2222 to the other side surface 2224. The discrete support element 2235 is made of two separate pieces 2236, 2237, wherein the cutting element is mechanically retained to the discrete support element pieces 2236, 2237 using a screw. Particularly, each piece 2236, 2237 is positioned adjacent to a cutting element side surface 2222, 2224, and a screw 2204 is inserted through the discrete support element pieces 2236, 2237 and the hole 2202 formed in the cutting element 2200. The screw 2204 holds the discrete support element pieces 2236, 2237 and the cutting element 2200 together using a bolt 2205. However, according to other embodiments, a discrete support element may be secured to a cutting element by other attachment means. The assembled discrete support element 2235 has an outer circumferential surface 2250, a front surface 2251, and a back surface 2252. As shown, the assembled cutting element 2200 and discrete support element 2235 has a cylindrical shape, wherein the front surface 2251, the back surface 2252, and the outer circumferential surface 2250 are flush with each of the cutting element circumferential surfaces 2212, 2232, 2214.

Figure 23A:
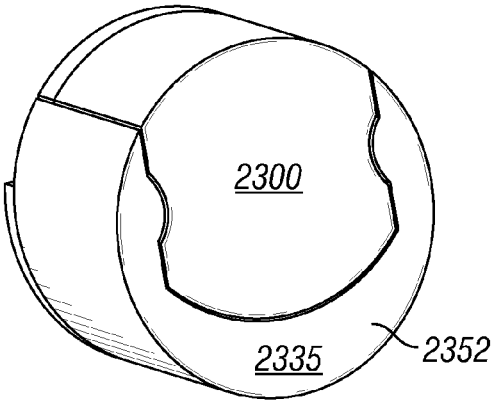
FIGS. 23A, 23B and 23C show perspective views of a cutting element and discrete support element according to embodiments of the present disclosure.
Figure 23C:
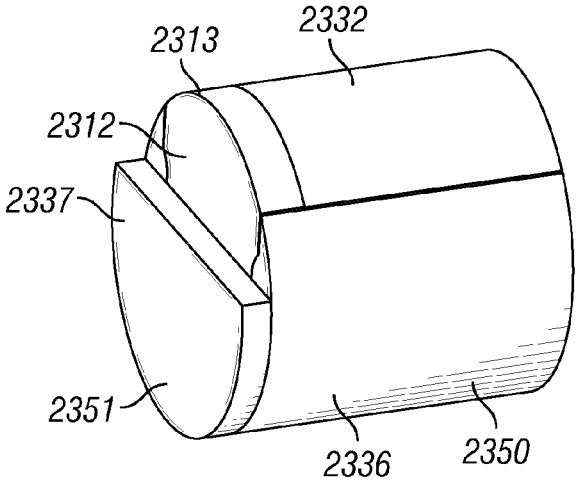
Figure 23B:
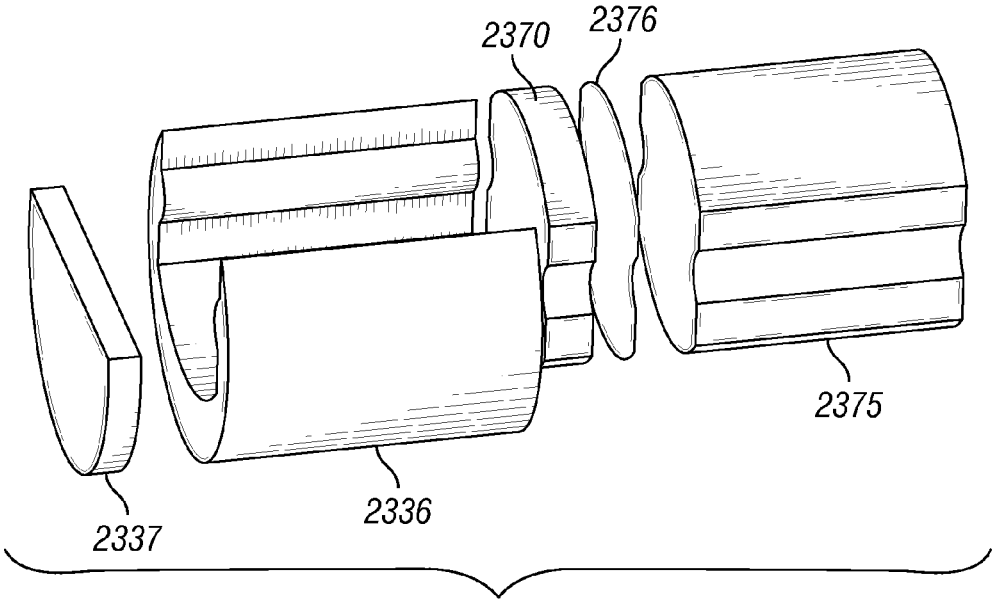

FIGS. 23A to 23C show perspective views of yet another embodiment of a cutting element 2300 disposed in a discrete support element 2335 made of more than one separate piece. As shown, the discrete support element 2335 has a front surface 2351, a back surface 2352, and an outer circumferential surface 2350, wherein a first piece 2337 forms the front surface 2351 and a second piece 2336 forms the back surface 2352 and the outer circumferential surface 2350. The first piece 2337 and the second piece 2336 are disposed around the cutting element 2300 such that a cutting edge 2313 of the cutting element 2300 is exposed, wherein the cutting edge 2313 is formed at the intersection of circumferential surfaces 2332 and 2312 of the cutting element 2300. The first piece 2337 and the second piece 2336 may be bonded together, for example by bonding methods known in the art, such as low shrink bonding, microwave brazing, torch brazing, laser brazing, welding, epoxy glue, etc. Although the discrete support element 2335 is shown as being formed of two pieces, other embodiments may have the discrete support element 2335 formed of a solid, continuous piece, for example, as shown in FIGS. 17A and 17B. Further, the cutting element 2300 has an abrasive table 2370 mounted to a substrate 2375 using a braze material 2376. The abrasive table 2370 may be made of polycrystalline diamond, thermally stable polycrystalline diamond, and/or cubic boron nitride, for example, and the substrate 2375 may be made of a carbide material, for example. The braze material 2376 may include silver, copper, copper active braze alloys, gold, gold active braze alloys, and/or nickel based alloys, for example, or any commercially available brazing alloys. The cutting element 2300 may be disposed within the discrete support element 2335 so that the abrasive table 2370 is oriented adjacent to the front surface 2351 of the discrete support element 2335.

Figure 8A:
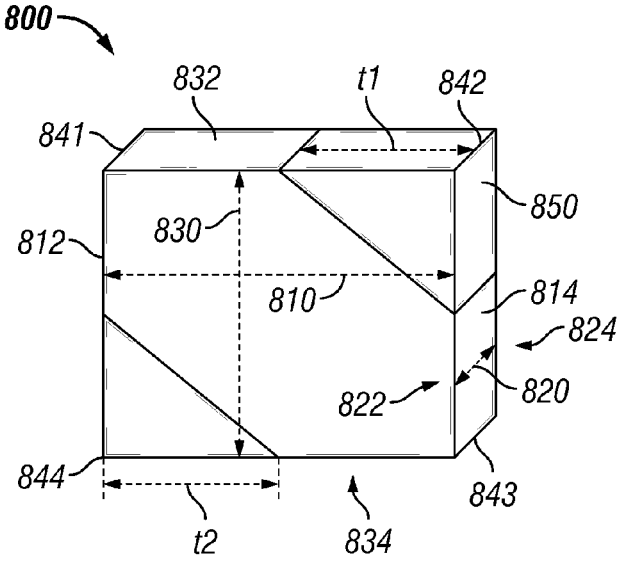
FIGS. 8A, 8B and 8C show a perspective view of a cutting element according to embodiments of the present disclosure.

In the embodiments illustrated above in FIGS. 5A to 5C and 6A to 6E, the entire cutting element is formed of a single material, diamond or a diamond composite material. However, according to some embodiments, at least one of the edges of a cutting element may be made of a polycrystalline diamond shearing element, while the remainder of the cutting element is made of a carbide material, such as tungsten carbide, or other cermet. For example, as shown in FIG. 8A, a cutting element may have two side surfaces 822, 824, and four circumferential surfaces 812, 814, 832, 834, each surface being defined by two of three dimensional values 810, 820, 830. Four circumferential edges 841, 842, 843, 844 are formed by the intersection of two of the circumferential surfaces 812, 814, 832, 834. Two of the four edges 842, 844 are formed from a polycrystalline diamond shearing element 850 extending a width of the shortest dimensional value 820 and a partial length of the long dimensional values 810, 830. In other embodiments, a polycrystalline diamond shearing element may form one edge, three edges, four edges, or more than four edges of a cutting element. Further, all or part of the polycrystalline diamond layer may be thermally stable polycrystalline diamond. The polycrystalline diamond shearing element may extend at least 0.20 inches (or at least 0.5 inches or at least 0.75 inches in other embodiments) of one or more surface that it forms.

Figure 8B:
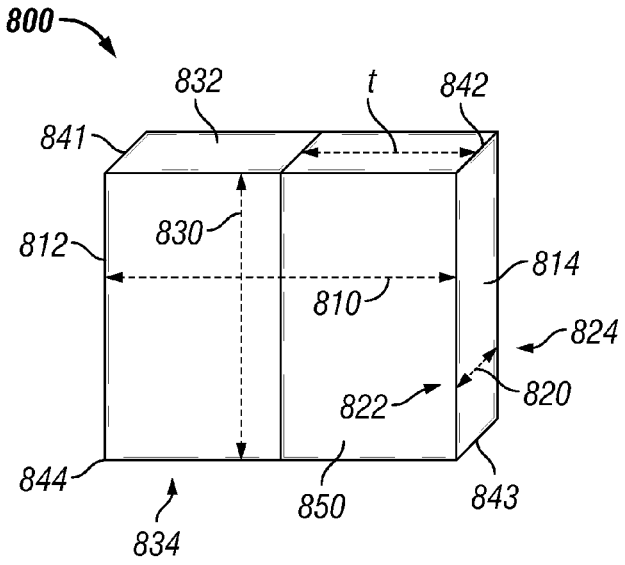

In another embodiment, a polycrystalline diamond shearing element may extend a width of the shortest dimensional value, the entire length of one of the two long dimensional values (along one surface), and at least a partial length of the other of the two long dimensional values (along an adjacent surface). For example, referring to FIG. 8B, a cutting element having three dimensional values 810, 820, 830 has four edges 841, 842, 843, 844 formed by the intersection of circumferential surfaces 812, 814, 832, 834. The polycrystalline diamond shearing element 850 extends a width of the short dimensional value 820 for two circumferential surfaces 832, 824, the entire length of circumferential surface 824 having a length of dimensional values 830, and a partial length t of circumferential surface 832 having a length of the long dimensional values 810. All or part of the polycrystalline diamond shearing element may be thermally stable polycrystalline diamond. Further, a polycrystalline diamond shearing element may extend a length t of at least 0.3 inches, rearward from edge 842.

Figure 8C:
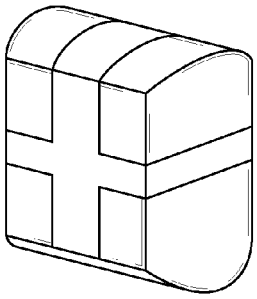

As used herein, the thickness of a diamond shearing element may refer to the distance the diamond is exposed rearward from a cutting edge. For example, referring back to FIG. 8A, a first thickness (t1) extends at least 0.2 inches across the circumferential surface 832, which may act as a cutting surface when the cutting element 800 is positioned in a slot (not shown) such that the edge 842 is the cutting edge. In the case where the cutting element 800 is rotated and repositioned within the slot to expose a new cutting edge, such as edge 844, a diamond shearing element forming that edge 844 may also have a thickness (t2) of at least 0.2 inches extending rearward from the cutting edge. It is within the scope of the present disclosure to use cutting elements having other shapes than the ones shown in FIGS. 8A and 8B that have a diamond shearing element with a thickness of 0.2 inches or greater adjacent the cutting edge, as illustrated in FIG. 8C, which includes four diamond shearing elements forming a portion of each surface.

Figure 9:
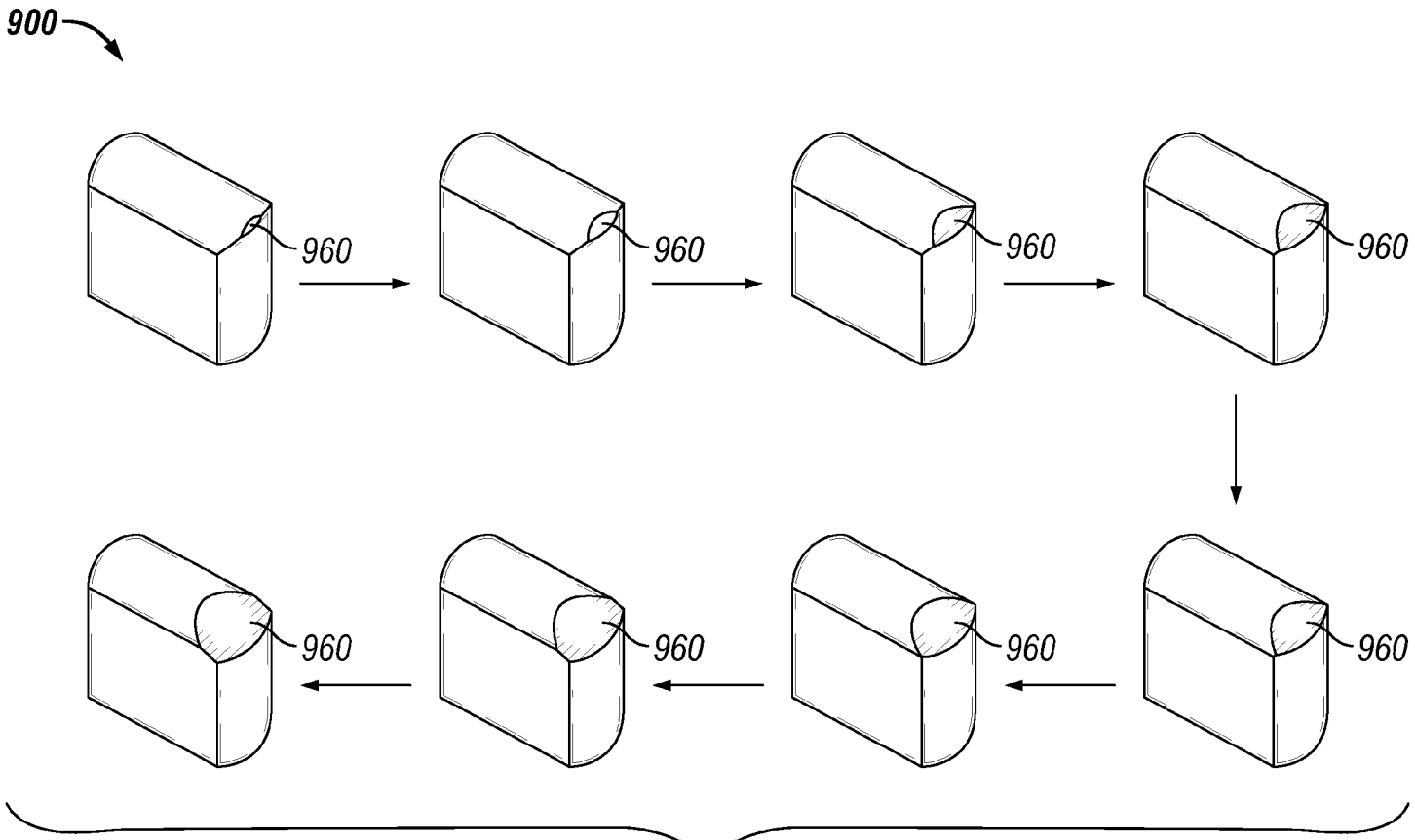
FIG. 9 shows the progression of a wear flat in a cutting element of the present disclosure.
Figure 10A:
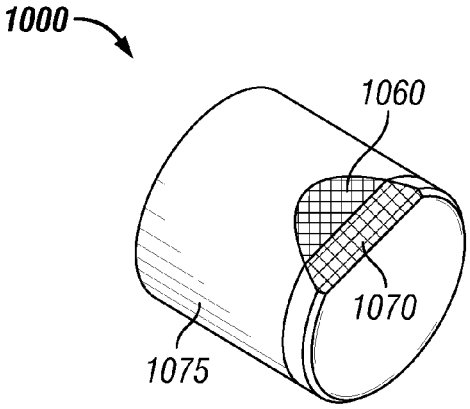
FIGS. 10A and 10B show a comparison between wear flat growth of a convention cutting element and wear flat growth of a cutting element according to embodiments of the present disclosure.
Figure 10B:
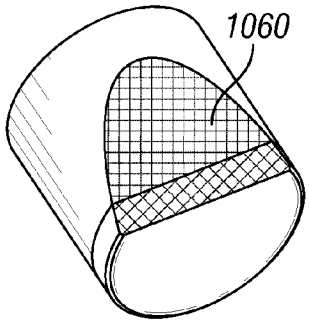
Figure 10C:
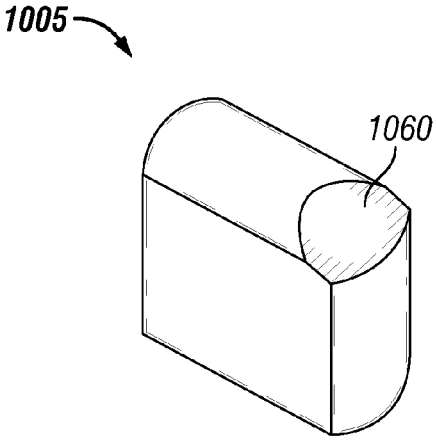
Figure 10D:
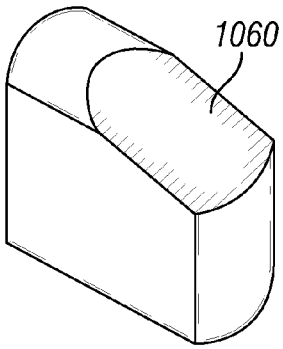

In one or more embodiments, by providing a diamond shearing element having a larger than customary thickness (such as greater than 0.2 inches) from the cutting edge, the shearing element, and thus cutting element, may have increased wear resistance, and thus a longer cutting life. For example, FIG. 9 shows the wear progression of the cutting surface of a cutting element 900 according to embodiments of the present disclosure having a diamond layer thickness of greater than 0.2 inches. As the cutting surface is worn, a wear flat 960 (or wear scar) may form. However, because cutting elements of the present disclosure may have a thicker than customary diamond body at the cutting surface, diamond may continue to be exposed as the wear flat 960 grows, thus maintaining an increased wear resistant cutting surface. FIGS. 10A and 10B show a comparison between the wear flat 1060 formed on a conventional cutting element 1000 and the wear flat 1060 formed on a cutting element 1005 according to embodiments of the present disclosure. In particular, as a wear flat 1060 grows larger than the thickness of a diamond layer 1070 in a conventional cutting element 1000 the wear flat 1060 begins to wear away the substrate 1075 (conventionally formed of carbide), which is typically less wear resistant than the diamond layer, and thus wears faster. Further, as wear flats in conventional cutters expand into the substrate portion of the cutter, failures arise from differences in coefficients of thermal expansion between the substrate material and the diamond cutting table, as well as from residual stress between the two materials. For example, heat generation at a wear flat in a conventional cutter caused by wear from contacting an earth formation may result in increased incidences of delamination due to the differences in coefficients of thermal expansion and residual stress between the substrate and the diamond table in the conventional cutter. In contrast, as a wear flat 1060 grows larger in a cutting element 1005 according to the present disclosure, which has a thicker diamond body than conventional cutting elements 1000, the wear flat 1060 continuously exposes more diamond. Thus, because the cutting surface of cutting elements according to the present disclosure are made of diamond body that are thicker than conventional cutting element diamond layers, the cutting surface of cutting elements according to the present disclosure may have more diamond exposure, and thus, increased wear resistance.

Figure 15:
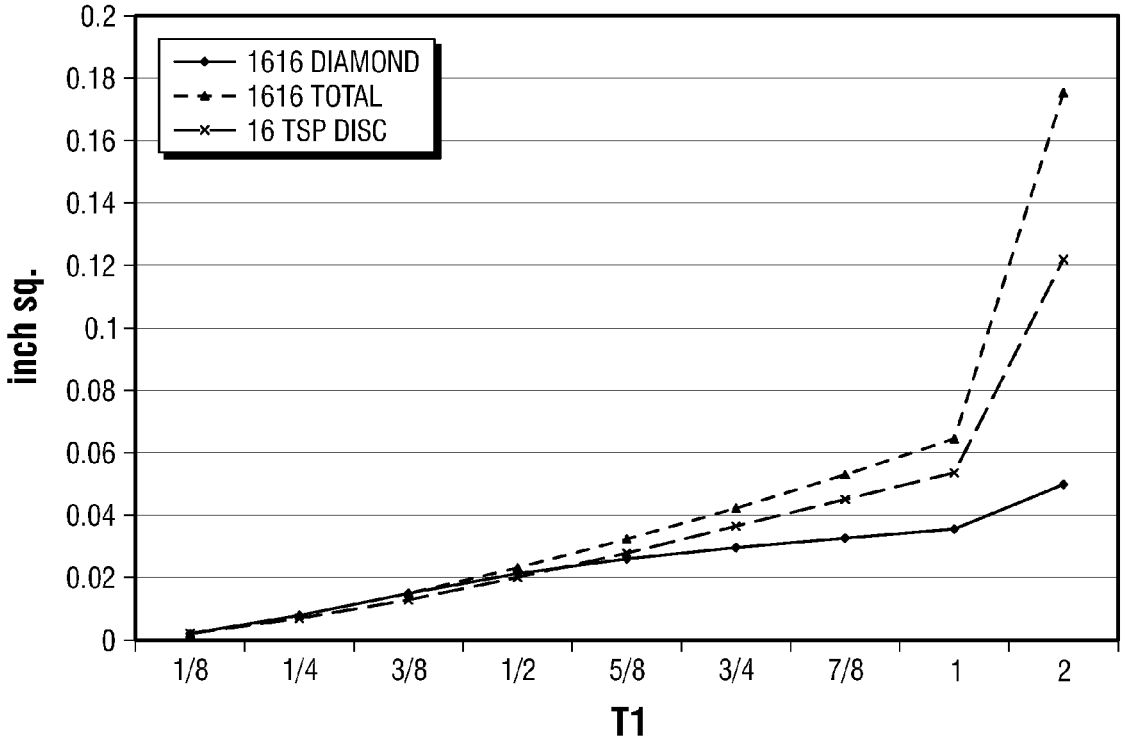
FIG. 15 shows a graph of the area of wear of conventional cutting elements and cutting elements of the present disclosure.

Referring now to FIG. 15, a comparison of the wear flat growth of a conventional cutter and a cutting element of the present disclosure is shown. As shown, the wear flat area of a diamond table of a conventional cutter (depicted by the dark blue line) may be limited by the thickness of the diamond table. Once the wear flat in the diamond table of a conventional cutter grows to contact the carbide substrate as well as the diamond table (depicted by the yellow line), the wear flat area may quickly increase at a faster rate than that of diamond alone. However, in cutting elements of the present disclosure that are made entirely from diamond (depicted by the light blue line), the wear flat area grows at a rate slower than that of conventional cutters having both substrate material and diamond exposed to wear.

In other embodiments, a cutting element may be made entirely of polycrystalline diamond, wherein either a partial amount of the polycrystalline diamond is thermally stable, or all of the polycrystalline diamond is thermally stable. In yet other embodiments, a cutting element may be made of varying grades of diamond by using varying sizes of diamond particles, varying amounts of catalyst material, and/or other techniques to form the polycrystalline diamond such that a gradient of at least one of diamond density, hardness, and toughness is created. For example, smaller diamond particles may be positioned at the outer surfaces of a cutting element and larger diamond particles may be positioned at the center of a cutting element (or other depth beneath the surfaces) so that when the diamond particles are sintered together, the outer surfaces (formed of the smaller diamond particles) are harder than the inner region formed of the larger diamond particles, thus forming a hardness gradient. Further, it is also within the scope of the present disclosure that more than two diamond grades may be used. In another embodiment, a mixture of catalyst material and diamond particles having substantially the same size may be sintered together to form a polycrystalline diamond cutting element, which may then be partially leached to form a binder gradient through the cutting element, wherein one or more sides of the cutting element is thermally stable and the remainder of the cutting element has gradually increasing amounts of catalyst material remaining.

According to embodiments of the present disclosure, a polycrystalline diamond layer may be subjected to a leaching process, whereby the catalyst material is removed from the PCD body, to form thermally stable polycrystalline diamond (TSP). As used herein, the term "removed" refers to the reduced presence of catalyst material in the PCD body, and is understood to mean that a substantial portion of the catalyst material no longer resides in the PCD body. However, one skilled in the art may appreciate that trace amounts of catalyst material may still remain in the microstructure of the PCD body within the interstitial regions and/or adhered to the surface of the diamond grains. Alternatively, rather than actually removing the catalyst material from the PCD body or compact, the selected region of the PCD body or compact can be rendered thermally stable by treating the catalyst material in a manner that reduces or eliminates the potential for the catalyst material to adversely impact the intercrystalline bonded diamond at elevated temperatures. For example, the catalyst material may be combined chemically with another material to cause it to no longer act as a catalyst material (or to have less thermal mismatch with diamond), or can be transformed into another material that again causes it to no longer act as a catalyst material (or to have less thermal mismatch with diamond). Accordingly, as used herein, the terms "removing substantially all" or "substantially free" as used in reference to the catalyst material is intended to cover the different methods in which the catalyst material can be treated to no longer adversely impact the intercrystalline diamond in the PCD body or compact with increasing temperature.

As described above, a conventional leaching process involves the exposure of an object to be leached with a leaching agent, such as described in U.S. Pat. No. 4,244,380, which is herein incorporated by reference in its entirety. In select embodiments, the leaching agent may be a weak, strong, or mixtures of acids. In other embodiments, the leaching agent may be a caustic material such as NaOH or KOH. Suitable acids may include, for example, nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

While conventional leaching techniques may require many weeks for sufficient removal of catalyst material from a PCD body to occur, in accordance with the present disclosure, accelerating techniques may be applied to the leaching process to decrease the amount of treatment time required to reach the same level of catalyst removal. Additionally, the use of the accelerating techniques of the present disclosure may also result in a more effective leaching. For example, the leaching of a PCD body may be accelerated by forming acid infusion pathways in the PCD body, so that the acid (or other leaching agent) may more readily access the interior portions of the PCD body, leading to a faster and cleaner leaching treatment. An acid infusion pathway may refer to any passage or structure through which a leaching agent (often acid) flows with less resistance than compared to an intercrystalline network of diamond grains so that such leaching agent may more readily infuse into interior regions of the polycrystalline diamond layer. Thus, for example, acid infusion pathways may include holes formed from removal of PCD material from the PCD body. According to some embodiments, at least one hole (or depression, as described in reference to FIGS. 16D and 16E) may extend partially into the diamond body of a cutting element from a surface of the cutting element, and/or at least one hole may extend all the way through the diamond body of a cutting element from on surface of the cutting element to another surface of the cutting element.

Figure 11:
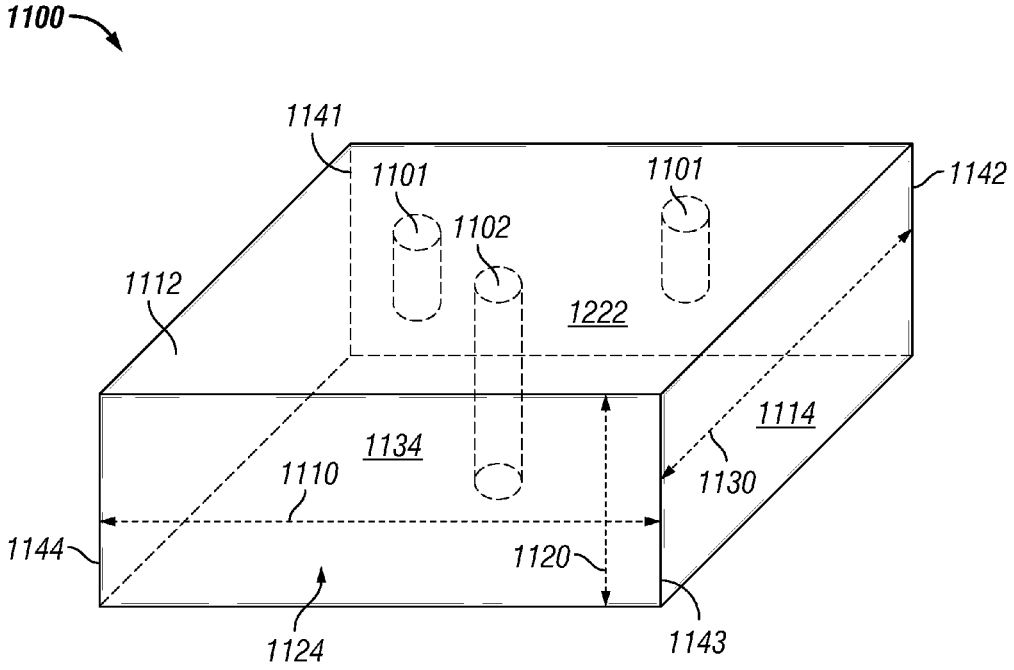
FIG. 11 shows a perspective view of a cutting element according to embodiments of the present disclosure.

For example, referring to FIG. 11, a cutting element 1100 having three dimensional values 1110, 1120, 1130, including a short dimensional value 1120 and two long dimensional values 1110, 1130. The cutting element 1100 is made entirely of polycrystalline diamond, wherein at least one hole 1101 extends partially into the diamond body from one of the two surfaces defining the shortest dimensional value 1122, and at least one hole 1102 extends completely through the diamond cutting element 1100 from one of the two surfaces defining the shortest dimensional value 1122 to the other surface defining the shortest dimensional value 1124. According to embodiments disclosed herein, at least one hole extending into a polycrystalline diamond cutting element may provide increased surface area of the polycrystalline diamond cutting element to facilitate leaching the diamond binder/catalyst from the diamond lattice.

Alternatively, TSP may be formed by forming the diamond body in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond body.

Figure 12:
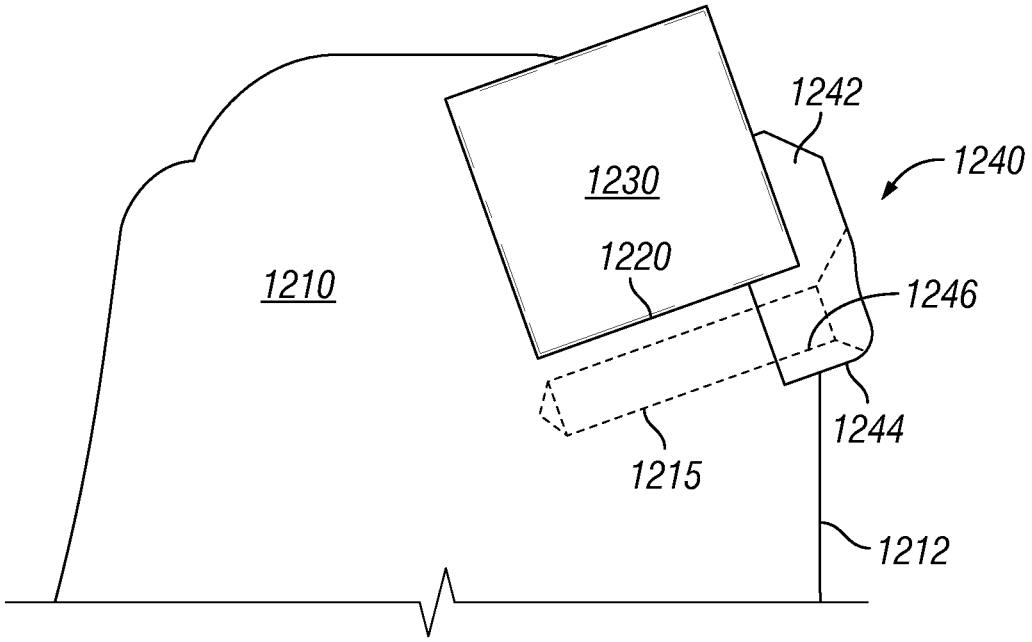
FIG. 12 is a cross-sectional view of a cutting element of the present disclosure attached to a drill bit blade.

Referring now to FIG. 12, a cross-sectional view of a mechanical retention mechanism 1240 used to retain a cutting element 1230 to a blade 1210 is shown. A mechanical retention mechanism 1240 of the present disclosure has a retention end 1242 and an attachment end 1244. The attachment end 1244 may have a hole 1246 there through such that a pin or a screw may be inserted through the hole 1246 in the attachment end 1244 and into a cavity 1215 formed within the blade 1210. The cavity 1215 may be positioned a distance below a slot 1220 in the blade 1210 (i.e., between the slot and the bit body of the drill bit) and extend from the leading face 1212 of the blade 1210 into the blade 1210, substantially parallel with the slot. However, other embodiments may have a cavity that extends into the blade at other directions. Further, as described above, a cutting element may be indirectly attached to a blade by being retained in a discrete support element that is attached to the blade rather being directly retained within the blade. In such embodiments, a mechanical retention mechanism may be inserted into the discrete support element holding the cutting element to retain the cutting element.

Figure 13A:
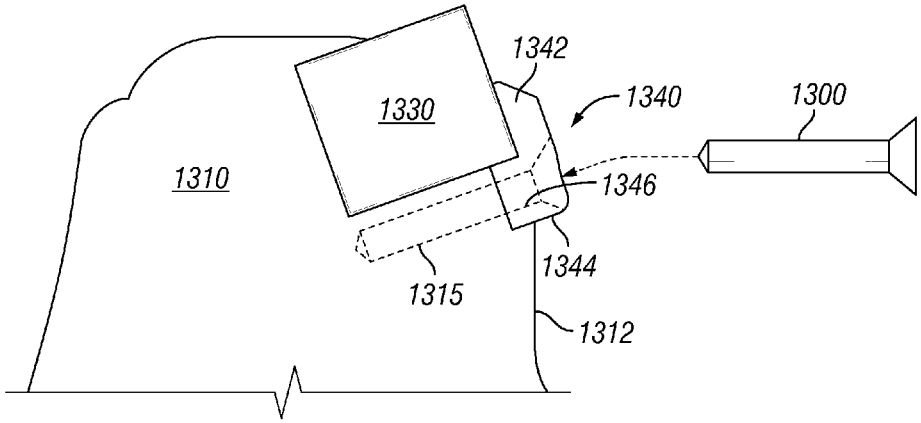
FIGS. 13A and 13B are a cross-sectional view of a cutting element of the present disclosure attached to a drill bit blade.
Figure 13B:
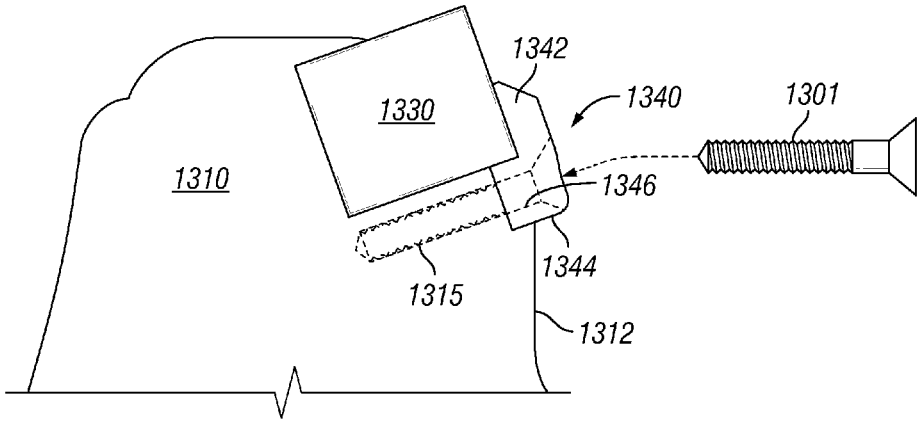

According to some embodiments, as shown in FIG. 13A, a pin 1300 may be inserted through a hole 1346 in the attachment end 1344 of a mechanical retention mechanism 1340 and into a cavity 1315 formed within the leading face 1312 of a blade 1310 to attach the attachment end 1344 to the blade 1310 and secure the retention end 1342 of the mechanical retention mechanism 1340 over a portion of a cutting element 1330. In another embodiment, shown in FIG. 13B, a screw 1301 or bolt may be threaded through a hole 1346 in the attachment end 1344 and into a threaded cavity 1315 formed within the leading face 1312 of the blade 1310 to threadably attach the attachment end 1344 to the blade 1310 and secure the retention end 1342 of the mechanical retention mechanism 1340 over a portion of a cutting element 1330. The threaded cavity 1315 may include a steel nut that has been infiltrated into the bit body, wherein threads may be machined in the inside of the nut before or after infiltration, or just machined into the bit body. If threads are machined into the nut before infiltration, materials such as graphite may be used to protect the structure of the hole and threads during the infiltration process. It is within the scope of the present disclosure that other techniques of mechanical retention may be used to attach the mechanical retention mechanism to the blade, such that the cutting element is held within a slot. For example, a spring retention mechanism may be used to secure the attachment end of a mechanical retention mechanism to a blade.

Figure 24A:
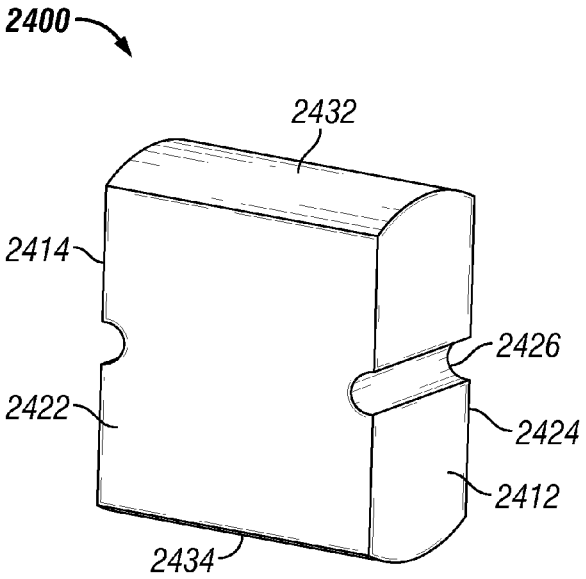
FIGS. 24A, 24B and 24C show perspective views and a cross-sectional view of a cutting element and a retention mechanism according to embodiments of the present disclosure.
Figure 24B:
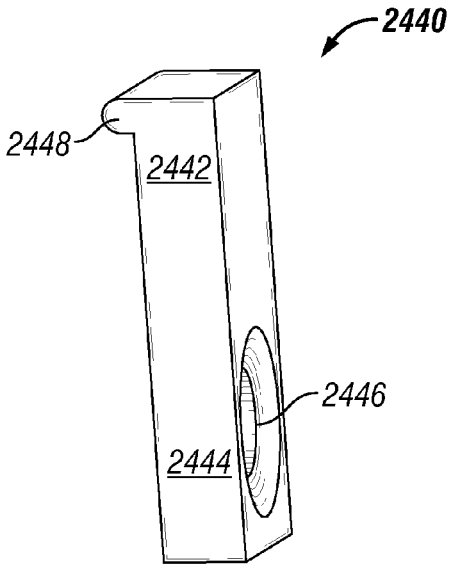
Figure 24C:
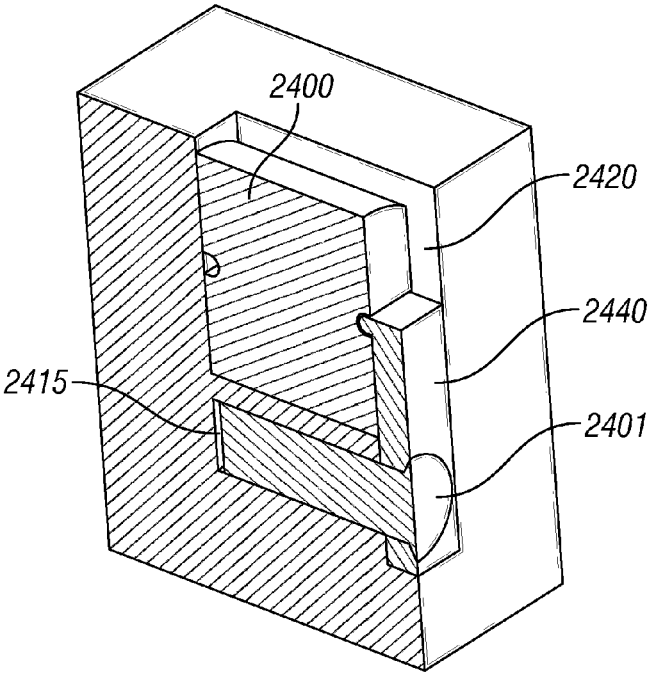

Referring now to FIGS. 24A to 24C, another embodiment of a mechanical retention mechanism used to retain a cutting element within a slot is shown. Particularly, FIG. 24A shows a perspective view of a cutting element 2400 having two side surfaces 2422, 2424 and four circumferential surfaces 2432, 2434, 2412, 2414, wherein a depression 2426 is formed in circumferential surfaces 2412 and 2414. FIG. 24B shows a perspective view of a mechanical retention mechanism 2440 having a lip 2448 formed at the retention end 2442 and a hole 2446 formed in the attachment end 2444. As shown in the cross-sectional view of FIG. 24C, a screw 2401 or pin may be inserted through the hole in the attachment end of the mechanical retention mechanism 2440 and into a cavity 2415 formed beneath the slot 2420 to attach the attachment end 2444 to a blade and secure the retention end 2442 of the mechanical retention mechanism 2440 over a portion of a cutting element 2400. Further, when the mechanical retention mechanism 2440 is assembled adjacent to the cutting element 2400, the lip 2448 formed at the retention end 2442 fits within a depression 2426 formed in a cutting element circumferential surface.

Figure 14:
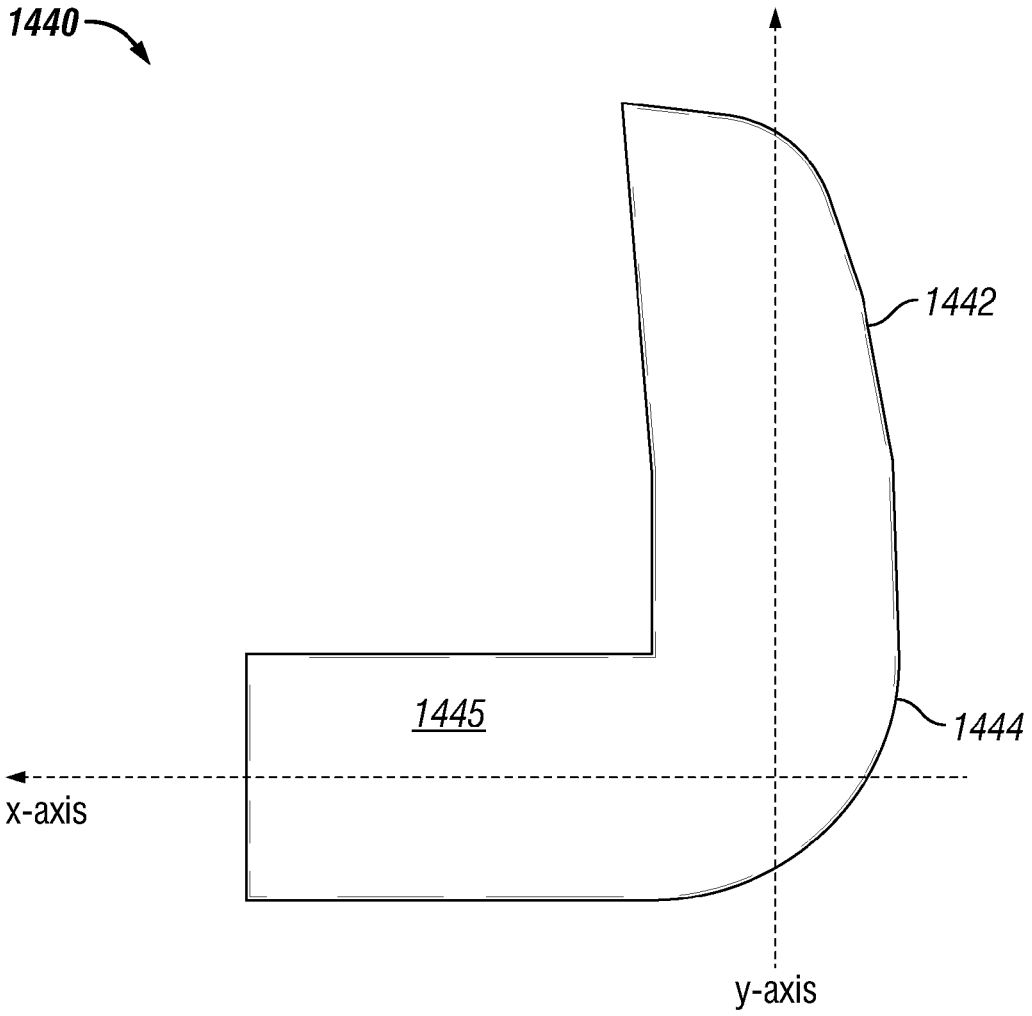
FIG. 14 is a cross-sectional view of a mechanical retention mechanism according to embodiments of the present disclosure.

In other embodiments of the present disclosure, the attachment end of a mechanical retention mechanism may be attached to a blade without the use of a pin, bolt, screw, etc. being inserted through an attachment end hole into a cavity formed within the blade. For example, the attachment end of a mechanical retention mechanism may have an insert piece that may be inserted into a cavity formed within the blade and attached thereto in order to secure a cutting element within a slot. Referring to FIG. 14, a cross-sectional view of a mechanical retention mechanism 1440 having an insert piece 1445 is shown, wherein the mechanical retention mechanism may be described using a conventional x-y coordinate system. As shown, the retention end 1442 extends along the y-axis and the insert piece 1445 extends from the attachment end 1444 along the x-axis at a 90° angle with the retention end 1442. Alternatively, the insert piece may extend from the attachment end at an acute angle (i.e., extend at an angle above the x-axis) or an obtuse angle (i.e., extend at an angle below the x-axis). In other embodiments, the insert piece may extend along a z-axis or at an angle therefrom. In yet other embodiments, the retention end and insert piece of the attachment end may be in the same plane (e.g., the retention end and the insert piece of the attachment end both extend along the y-axis, intersecting at a 180° angle). Depending on the reciprocating place of attachment on the bit, the insert piece of the attachment end may extend in various directions in relation to the retention end of the mechanical retention mechanism. The insert piece may be threadably attached to a threaded cavity formed below a slot within the leading face of a blade, or otherwise mechanically attached or brazed to the blade.

Further, in various embodiments of the present disclosure, the retention end of a mechanical retention mechanism may have a smaller or larger volume than the attachment end, or the retention end and attachment end of a mechanical retention mechanism may have substantially equal volumes. According to embodiments of the present disclosure, an insert piece of the attachment end, or a pin, screw, bolt, etc., of a mechanical retention mechanism may be configured to have a thickness to minimize breakage during drilling. Further, attachment means of the mechanical retention mechanism (e.g., insert piece, screw, bolt, pin, etc.) may have a length less than or equal to the length the slot extends into the blade. Additionally, the size of the retention end of a mechanical retention mechanism may be characterized by the percentage of the leading face of the cutting element (i.e., the surface of the cutting element exposed at the leading face of a blade) that the retention end covers. For example, the retention end of a mechanical retention mechanism may cover up to about 70 percent of the leading face of the cutting element, or may cover between 10 and 50 percent of the leading face of the cutting element. Further, in some embodiments, the retention end may cover between 10 and 30 percent of the leading face of the cutting element.

The type of retention mechanism is no limitation on the present disclosure, but may include mechanical retention by covering and/or interacting with a leading surface of cutting element, a side surface cutting element, or a lower surface of the cutting element. In some embodiments, the retention mechanisms described in U.S. Patent Application No. 61/351,035, which is assigned to the present assignee and herein incorporated by reference in its entirety, may be used to partially cover and retain the cutting element.

Figure 25A:
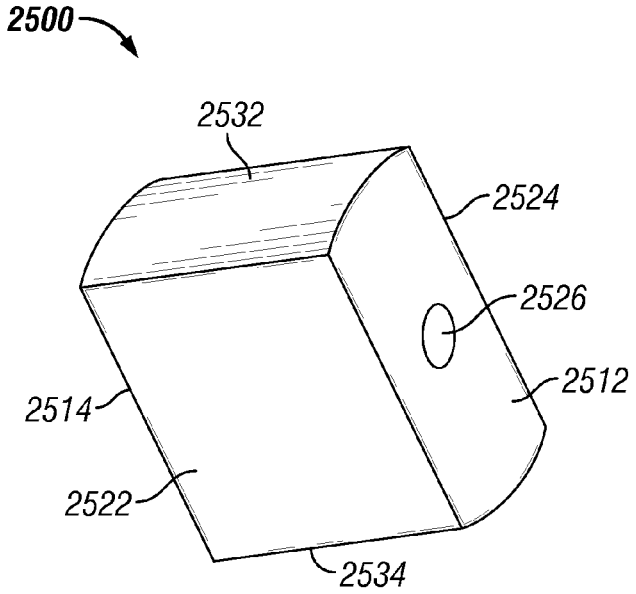
FIGS. 25A, 25B, 25C and 25D show perspective views and a cross-sectional view of a cutting element and a retention mechanism according to embodiments of the present disclosure.
Figure 25B:
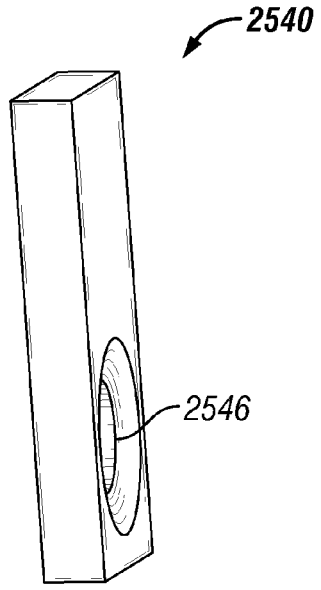
Figure 25C:
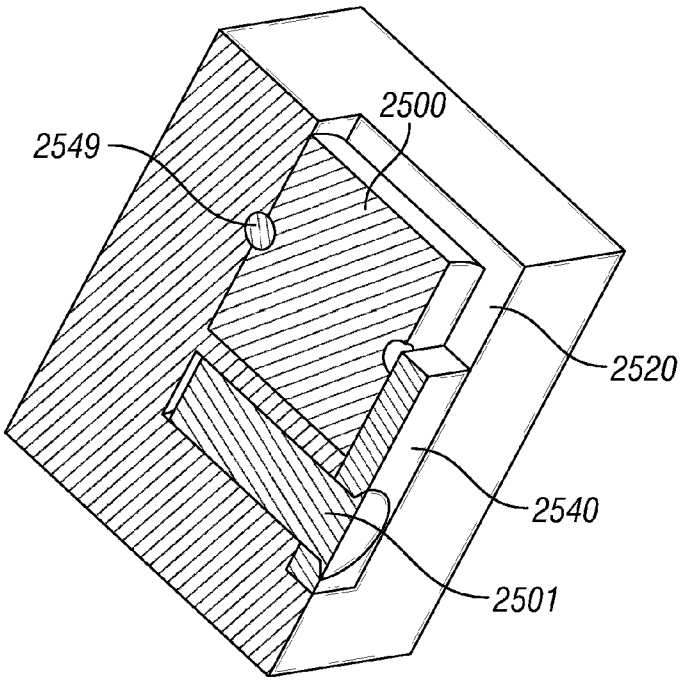
Figure 25D:
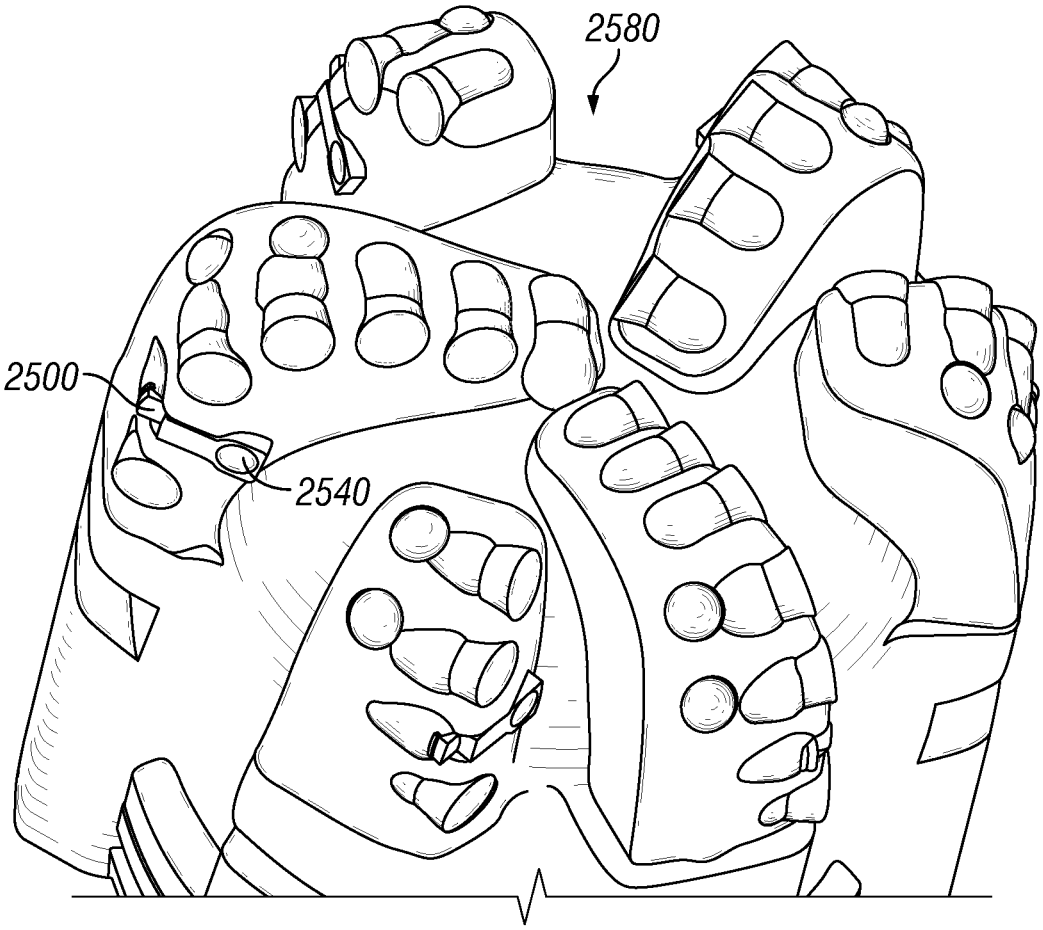

According to other embodiments, more than one mechanical retention mechanism may be used to retain a cutting element within a slot. For example, referring to FIGS. 25A to 25D, a cutting element 2500 is retained within a slot 2520 using a mechanical retention mechanism 2540 and a back retainer 2549. A perspective view of a cutting element 2500 according to embodiments of the present disclosure is shown in FIG. 25A, wherein the cutting element 2500 has two side surfaces 2522, 2524 and circumferential surfaces 2512, 2514, 2532, 2534. A depression 2526 is formed in at least one circumferential surface 2512. FIG. 25B shows a perspective view of a mechanical retention mechanism 2540, wherein a hole 2546 is formed in the attachment end of the mechanical retention mechanism 2540. As shown in the cross-sectional view of FIG. 25C, a pin 2501 is inserted through the hole 2546 in the mechanical retention mechanism 2540 into a cavity formed below a slot 2520 to retain the cutting element 2500 within the slot 2520. Further, a back retainer 2549 is disposed between the slot 2520 and the cutting element 2500, wherein the back retainer 2549 fits within the depression 2526 formed in the cutting element circumferential surface 2512 to retain the cutting element 2500 within the slot 2520. The back retainer 2549 and depression 2526 shown have corresponding hemispherical shapes. However, other embodiments may have different corresponding shapes. FIG. 25D shows a perspective view of the cutting element 2500 retained within a slot formed in a drill bit 2580 using a mechanical retention mechanism 2540 and a back retainer (not shown). According to embodiments of the present disclosure, a diamond table of a cutting element may be exposed above the top surface of the cutting element support structure (e.g., above the top surface of a blade, as shown in FIG. 25D).

Figure 26A:
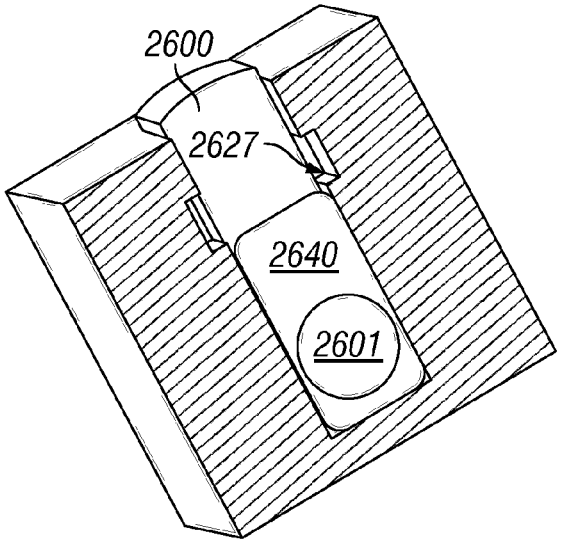
FIGS. 26A, 26B and 26C show a perspective view and cross-sectional views of a cutting element and retention mechanism according to embodiments of the present disclosure.
Figure 26B:
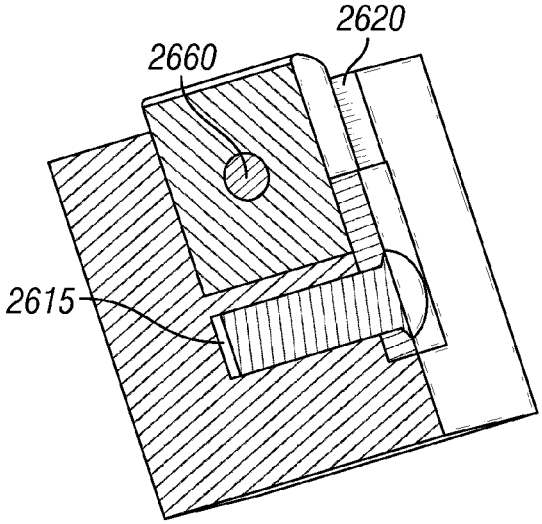
Figure 26C:
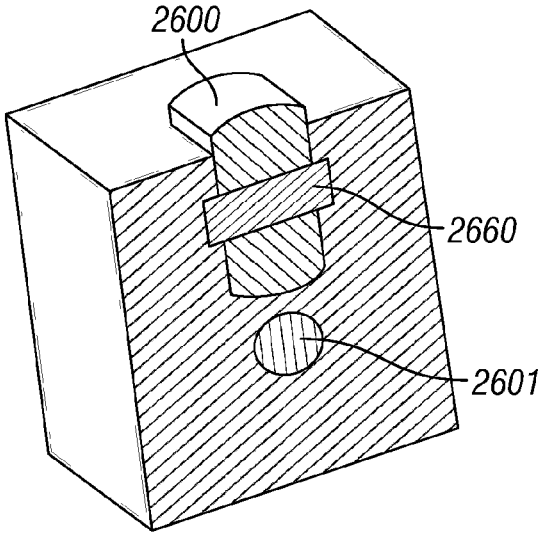

FIGS. 26A to 26C show another embodiment of a cutting element retained within a slot using more than one mechanical retention mechanism. Particularly, FIGS. 26A to 26C show a front view (FIG. 26A) and two cross-sectional views (FIGS. 26B and 26C) of a cutting element 2600 retained within a slot 2620 using a mechanical retention mechanism 2640 and a secondary retention mechanism 2660. The secondary retention mechanism 2660 is a pin that is inserted through the cutting element 2600 such that the secondary retention mechanism 2660 protrudes from opposite sides of the cutting element 2600. Although the secondary retention mechanism is shown as a cylindrical shaped pin in FIGS. 26A to 26C, other embodiments have differently shaped secondary retention mechanisms that protrude from the cutting element. For example, a secondary retention mechanism may be a rectangular shaped pin. The cutting element 2600 having the secondary retention mechanism 2660 protruding there through is inserted within a slot 2620 having grooves 2627 along the slot side walls 2623 that correspond with the protruding secondary retention mechanism 2660. Thus, the protruding secondary retention mechanism 2660 may fit within the grooves 2627, thereby allowing the cutting element 2600 and secondary retention mechanism 2660 to slide within the slot 2620 along a first direction while preventing the cutting element 2600 and secondary retention mechanism 2660 from coming out of the slot in other directions. A mechanical retention mechanism 2640 is positioned adjacent to the cutting element 2600 along the first direction to prevent the cutting element 2600 from coming out of the slot 2620 along the first direction. The mechanical retention mechanism 2640 is attached to a cutting tool by inserting a screw 2601 through the mechanical retention mechanism 2640 and into a cavity 2615 formed below the cutting element 2600 such that a portion of the mechanical retention mechanism 2640 covers a portion of the cutting element 2600.

In yet other embodiments, cutting elements of the present disclosure may be mechanically retained to a drill bit blade (or a substrate attached to a blade) without the use of a mechanical retention mechanism positioned adjacent to the leading face of the cutting element support structure. For example, as described above in reference to holding a cutting element within a substrate slot, bit blade material may extend over a portion of a cutting element exposed at the top side of the blade to retain the cutting element. In another example, a cutting element may be retained by a tapered wall of the slot, wherein the tapered wall acts as a wedge to prevent the cutting element from sliding or popping out of the slot. Referring back to FIG. 5C, a slot tapered wall 521 may form the surface of the slot 520 farthest away from the leading face 512 of the blade 510. The taper of the tapered wall 521 may wedge the cutting element toward the bit body (not shown) to keep the cutting element from coming out of the slot 520 at the top side 514 of the blade 510. Cutting elements typically encounter removal forces at the cutting edge of the cutting element as the bit rotates and contacts the working surface. Such contact forces may be offset by the force exerted by the tapered wall, thus retaining the cutting element within the slot. Although FIG. 5C shows a slot in a discrete support element having a tapered wall, a slot formed directly in a bit blade may also have a tapered wall. Further, cutting elements of the present disclosure may be mechanically retained to a cutting element support structure (e.g., a blade) using discrete support elements, such as, for example, the discrete support elements shown in FIGS. 17A, 17B, 19A to 21C and 23A to 23C. In embodiments having a cutting element mechanically retained to a cutting element support structure by a discrete support element, the retention mechanism may include mating surface geometry between the cutting element and the discrete support element (for example, as shown in FIGS. 19A to 21C) and/or the retention mechanism may include a front portion that impedes or blocks the cutting element from sliding out of the discrete support element (for example, as shown in FIGS. 17A, 17B and 23A to 23C).

Figure 27A:
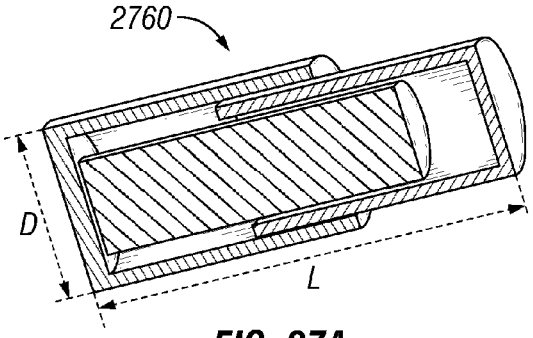
FIGS. 27A, 27B, 27C and 27D show perspective views and a cross-sectional view of a cutting element and a retention mechanism according to embodiments of the present disclosure.
Figure 27B:
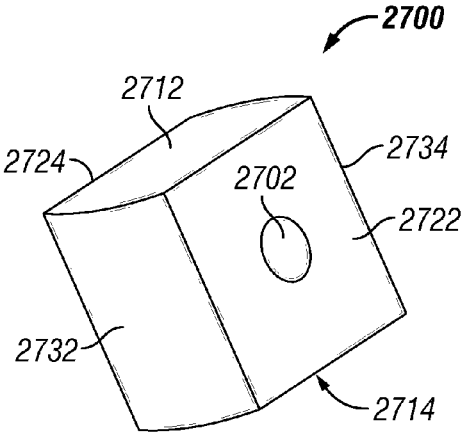
Figure 27C:
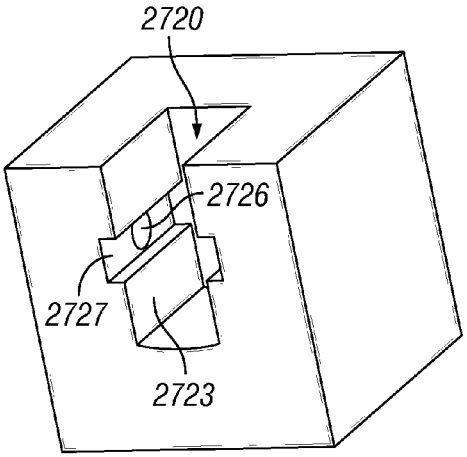
Figure 27D:
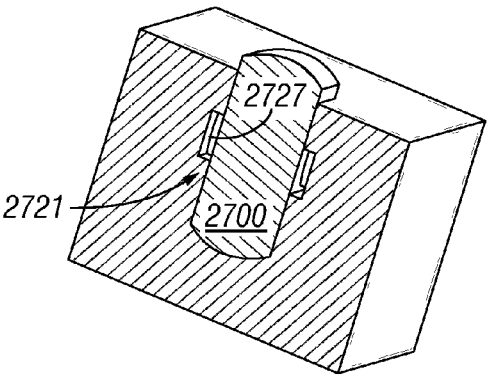

FIGS. 27A to 27D show another embodiment of a cutting element 2700 mechanically retained within a slot 2720 without the use of a mechanical retention mechanism at the leading face 2721 of the cutting element support structure. Particularly, FIG. 27B shows a perspective view of a cutting element 2700 according to embodiments of the present disclosure having two side surfaces 2722, 2724 and circumferential surfaces 2712, 2732, 2714, 2734. A hole 2702 extends through the cutting element 2700 from one side surface 2722 to the opposite side surface 2724. FIG. 27A shows a cross-sectional view of a spring retention mechanism 2760, wherein the diameter D at the thickest part of the spring retention mechanism 2760 may fit within the hole 2702 formed in the cutting element 2700, and wherein the length L of the spring retention mechanism 2760 in its expanded form is larger than the length of the hole 2702. Thus, in its expanded form, the spring retention mechanism 2760 protrudes from at least one side of the hole 2702 formed in the cutting element 2700. FIG. 27C shows a perspective view of a slot 2720 having at least one side wall 2723 with a groove 2727 formed therein. A depression 2726 is formed within the groove 2727, wherein the depression 2726 corresponds with the shape at an end of the spring retention mechanism 2760. For example, as shown, the spring retention mechanism 2760 may have cylindrical shaped ends and the depression 2726 has a corresponding cylindrical shape such that an end of the spring retention mechanism 2726 may fit within the depression 2726. However, according to other embodiments, the shape at an end of the spring retention mechanism and corresponding depression may be different, such as hemispherical or rectangular, for example. FIG. 27D shows a perspective view of the cutting element 2700 assembled within the slot 2720. Particularly, once the spring retention mechanism 2760 is inserted through the hole 2702 in the cutting element 2700, the cutting element 2700 and spring retention mechanism 2760 may be inserted into the slot 2720 by sliding the assembly into the slot until the spring retention mechanism expands into the corresponding depression 2726 formed in the slot side wall 2723.

A method of replacing the cutting edge of a cutting element is also within the scope of the present disclosure. According to one embodiment, a bit body having a plurality of blades extending from the bit body, wherein each blade has a leading face, a top side, and a trailing face, and wherein at least one blade has at least one slot formed therein, the at least one slot having two side surfaces and each side surface intersecting with both the leading face and top side of the blade, is provided. A cutting element having a geometry described herein may be positioned in the at least one slot such that the shortest dimensional width lies in a place that intersects the slot side surfaces. Alternatively, the cutting element may be positioned with a different orientation, for example, so that the shortest dimensional value does not interface the slot side surfaces, or so that the longest dimensional value extends rearwardly from the leading edge of the cutting element, or in any other orientation so long as a diamond surface extends at least 0.3 inches rearwardly from the leading edge of the cutting element. A mechanical retention mechanism may then be attached to the leading face of the blade such that the mechanical retention mechanism partially covers the cutting element. However, according to other embodiments, other types of mechanical retention mechanisms may be used to retain the cutting element within a slot. The cutting edge of the cutting element may be whichever edge of the cutting element that is exposed at the intersection of the top side and leading face of the blade (as described above in the definition of "cutting edge"). The method of replacing the cutting edge of a cutting element may include removing the mechanical retention mechanism from partially covering the cutting element, removing the cutting element from the slot, and rotating the cutting element within the slot, wherein a different edge is exposed at the intersection of the top side and leading face of the blade, thus exposing a new cutting edge. Once the new cutting edge of the cutting element is exposed, the mechanical retention mechanism may be reattached to the blade or replaced to partially cover the cutting element and secure the cutting element within the slot.

The cutting elements of the present disclosure may be incorporated in various types of cutting tools, including for example, as cutters in fixed cutter bits or on borehole enlargement tools such as reamers. Thus, the structure on which the cutting elements of the present disclosure may be installed may be referred to as a cutting element support structure, i.e., a blade for fixed cutter bit or a reamer. Bits having the cutting elements of the present disclosure may include a single cutting element oriented in accordance with the present disclosure with the remaining cutting elements being conventional cutting elements, all cutting elements having the present orientation, or any combination therebetween of oriented and conventional cutting elements.

In one or more embodiments, by mechanically attaching the cutting element to the drill bit, the cutting element is subject to less thermal exposure than conventional cutting elements, which are typically attached to the drill bit by brazing. Thus, the cutting elements of the present disclosure may be subject to less thermal degradation than conventional cutting elements. Further, the mechanical attachment of the cutting element to the drill bit allows the cutting element to be made completely of diamond, which is otherwise difficult if not incapable of being adequately brazed to the drill bit. Because cutting elements of the present disclosure may optionally be made entirely of diamond and do not require a substrate for attachment to the bit, the cutting elements may be made using a 1-cycle process of sintering. As such, processing time and costs may be decreased. Further, the orientation of the cutting element on the bit or other cutting tool may allow for improved wear properties, including a greater amount of ultrahard material to wear, as compared to a conventional diamond table for which the wear flat develops into the less wear resistant substrate (which causes the wear flat to more quickly develop).

Additionally, cutting elements of the present disclosure may take up less space on a cutting tool blade, which may provide an increased amount of diamond cutting surface density. For example, because the cutting elements of the present disclosure may be smaller, more may fit on a blade, thus providing an increased amount of diamond cutting surfaces.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting tool comprising:

a tool body;

a plurality of cutting element support structures extending from the tool body, wherein each cutting element support structure has a leading face, a top side, and a trailing face;

at least one slot formed in at least one of the cutting element support structures, wherein the at least one slot comprises two side surfaces, each of the two side surfaces comprising a planar portion, and each of the two side surfaces terminating at the leading face and top side of the cutting element support structure;

a cutting element comprising a diamond shearing element having a plurality of surfaces, wherein each surface has two dimensional values, and wherein the cutting element is positioned in the at least one slot such that a plane in which the shortest dimensional value lies intersects the slot side surfaces; and at least one mechanical retention mechanism adjacent to the cutting element, wherein the cutting element is rotationally fixed with respect to the at least one slot.

2. The cutting tool of claim 1, wherein the cutting element possesses four edges along the shortest dimensional value, and wherein at least one of the edges comprises thermally stable polycrystalline diamond.

3. The cutting tool of claim 1, wherein the diamond cutting element comprises thermally stable polycrystalline diamond extending at least 0.3 inches rearward from the leading edge of the cutting element.

4. The cutting tool of claim 1, wherein the cutting element consists of polycrystalline diamond.

5. The cutting tool of claim 1, wherein at least one hole extends through the cutting element substantially parallel to the plane of the shortest dimensional value.

6. The cutting tool of claim 1, wherein a cavity is formed in the cutting element support structure below the slot and wherein a pin or screw extends through a hole in the mechanical retention mechanism and into the cavity to attach the mechanical retention mechanism to the cutting element support structure.

7. The cutting tool of claim 1, wherein the cutting element further comprises a carbide substrate attached to the diamond shearing element along at least two surfaces of the diamond shearing element.

8. The cutting tool of claim 7, wherein the cutting element further comprises at least one other diamond element attached to the carbide substrate along at least two surfaces of the at least one other diamond element.

9. The cutting tool of claim 1, wherein the at least one mechanical retention mechanism is selected from one or more of a mechanical retention mechanism positioned adjacent to the leading face of the cutting element support structure, a pin, a spring retention mechanism, a back retainer, a tapered slot wall, a screw, mating surface geometry, and a portion of the cutting element support structure.

10. The cutting tool of claim 9, wherein at least one mechanical retention mechanism is mating surface geometry comprising at least one of a depression and a protrusion formed on a surface of the cutting element and at least one of a corresponding depression and corresponding protrusion formed on at least one of the side surfaces of the slot.

11. The cutting tool of claim 9, wherein at least one mechanical retention mechanism is a spring retention mechanism extending through the cutting element and into at least one of the side surfaces of the slot.

12. The cutting tool of claim 9, wherein at least one mechanical retention mechanism is positioned adjacent to the leading face of the cutting element support structure and comprises:

a retention end; and an attachment end;

wherein the retention end covers a portion of the cutting element.

13. The cutting tool of claim 1, further comprising a discrete support element, wherein the at least one slot is formed in the discrete support element, and wherein the discrete support element is attached to the at least one cutting element support structure.

14. The cutting tool of claim 13, wherein the discrete support element comprises more than one separate piece.

15. The cutting tool of claim 13, wherein the discrete support element is mechanically attached to the cutting element.

16. A drill bit comprising:

a bit body;

a plurality of blades extending from the bit body, wherein each blade has a leading face, a top side, and a trailing face;

at least one slot formed in at least one of the plurality of blades, wherein the at least one slot comprises two side surfaces, each of the two side surfaces comprising a planar portion, and each of the two side surfaces terminating at the leading face and top side of the blade;

a cutting element comprising a diamond shearing element having a plurality of surfaces, wherein each surface has two dimensional values, and wherein the cutting element is positioned in the at least one slot such that a plane in which the longest dimensional value is substantially parallel with the slot side surfaces; and at least one mechanical retention mechanism adjacent to the cutting element, wherein the cutting element is rotationally fixed with respect to the at least one slot.

17. The drill bit of claim 16, wherein the longest dimensional value extends at least 0.3 inches rearward from the leading edge of the diamond shearing element.

18. The drill bit of claim 16, wherein at least one hole extends through the cutting element substantially parallel to the plane of the shortest dimensional value.

19. The drill bit of claim 16, wherein a cavity is formed in the blade below the slot and wherein a pin or screw extends through a hole in the mechanical retention mechanism and into the cavity to attach the mechanical retention mechanism to the blade.

20. The drill bit of claim 16, wherein the cutting element further comprises a discrete support element attached to the diamond shearing element along at least two surfaces of the diamond shearing element.

21. The drill bit of claim 20, wherein the cutting element further comprises at least one other diamond element attached to the discrete support element along at least two surfaces of the at least one other diamond element.

22. The drill bit of claim 16, wherein the at least one mechanical retention mechanism is selected from one or more of a mechanical retention mechanism positioned adjacent to the leading face of the cutting element support structure, a pin, a spring retention mechanism, a back retainer, a tapered slot wall, a screw, mating surface geometry, and a portion of the blade.

23. The drill bit claim 22, wherein at least one mechanical retention mechanism is mating surface geometry comprising at least one of a depression and a protrusion formed on a surface of the cutting element and at least one of a corresponding depression and corresponding protrusion formed on at least one of the side surfaces of the slot.

24. A drill bit comprising:

a bit body;

a plurality of blades extending from the bit body, wherein each blade has a leading face, a top side, and a trailing face;

at least one slot formed in at least one of the plurality of blades, wherein the at least one slot comprises two side surfaces, each of the two side surfaces comprising a planar portion, and each of the two side surfaces terminating at the leading face and top side of the blade;

a diamond cutting element having a plurality of surfaces, wherein each surface has two dimensional values, and wherein the diamond cutting element is positioned in the at least one slot such that a plane in which the shortest dimensional value lies does not interface the slot side surfaces; and at least one mechanical retention mechanism adjacent to the diamond cutting element, wherein the diamond cutting element is rotationally fixed with respect to the at least one slot.

25. A method of replacing a cutting surface of a cutting element, comprising:

providing a bit body having a plurality of blades extending from the bit body;

wherein each blade has a leading face, a top side, and a trailing face;

wherein at least one blade has at least one slot formed therein, wherein the at least one slot comprises two side surfaces, each of the two side surfaces comprising a planar portion, and each of the two side surfaces intersecting with the leading face and top side of the blade;

wherein a cutting element is disposed in the at least one slot, the cutting element comprising three dimensional values, wherein each dimensional value is defined by its longest length measured between two opposite surfaces, wherein the surfaces intersect to form four edges, and wherein the cutting element is positioned in the at least one slot such that the shortest dimensional value intersects the slot side surfaces; and wherein at least one mechanical retention mechanism is adjacent to the cutting element;

removing the at least one mechanical retention mechanism;

removing the cutting element from the slot;

replacing the cutting element into the slot, wherein a different surface is exposed at the intersection of the top side and leading face of the blade; and replacing the at least one mechanical retention mechanism.

26. A drill bit comprising:

a bit body;

a plurality of blades extending from the bit body, wherein each blade has a leading face, a top side, and a trailing face;

at least one cutter pocket formed in at least one of the plurality of blades;

at least one discrete support element comprising a slot, wherein the at least one discrete support element fits within the at least one cutter pocket such that the slot is exposed at the leading face and the top side of the blade, and wherein the slot comprises two opposite side surfaces, each of the two side surfaces comprising a planar portion and each of the two side surfaces intersecting with the leading face and top side of the blade;

a cutting element mechanically retained in the slot, the cutting element comprising three dimensional values, wherein each dimensional value is defined by its longest length measured between two opposite surfaces, wherein the surfaces intersect to form four edges, and wherein the cutting element is positioned in the at least one slot such that the shortest dimensional value intersects the slot side surfaces.

* * * * *